US005761206A

United States Patent [19]

Kackman

[11] Patent Number: 5,761,206

[45] Date of Patent: Jun. 2, 1998

[54] MESSAGE PACKET PROTOCOL FOR COMMUNICATION OF REMOTE SENSOR INFORMATION IN A WIRELESS SECURITY SYSTEM

[75] Inventor: Gerald M. Kackman, St. Paul, Minn.

[73] Assignee: Interactive Technologies, Inc., North St. Paul, Minn.

[21] Appl. No.: 599,627

[22] Filed: Feb. 9, 1996

[51] Int. Cl.[6] ..... G08B 1/08; G08B 25/00

[52] U.S. Cl. ..... 370/476; 370/311; 340/506; 340/531; 340/636; 340/825.36

[58] Field of Search ..... 370/216, 349, 370/389, 470, 471, 474, 475, 476, 311; 340/506, 540, 635, 636, 825.06, 835.36, 825.49, 870.16, 539; 364/550

[56] References Cited

U.S. PATENT DOCUMENTS

| | | | |
|---|---|---|---|
| 4,672,365 | 6/1987 | Gehman et al. | 340/539 |
| 4,737,770 | 4/1988 | Brunius et al. | 340/506 |
| 4,761,648 | 8/1988 | Ellis | 340/539 |
| 4,855,713 | 8/1989 | Brunius | 340/531 |
| 4,906,055 | 3/1990 | Horiuchi | 307/354 |
| 4,947,484 | 8/1990 | Twitty et al. | 371/37.1 |
| 4,951,029 | 8/1990 | Severson | 340/506 |
| 5,302,902 | 4/1994 | Groehl | 324/434 |
| 5,331,318 | 7/1994 | Montrgomery | 340/855.4 |
| 5,363,071 | 11/1994 | Schwent et al. | 333/111 |
| 5,410,536 | 4/1995 | Shah et al. | 370/216 |
| 5,506,572 | 4/1996 | Hills et al. | 340/636 |
| 5,512,890 | 4/1996 | Everson, Jr. et al. | 340/870.13 |
| 5,559,499 | 9/1996 | Haubner | 340/636 |
| 5,602,831 | 2/1997 | Gaskill | 370/252 |

OTHER PUBLICATIONS

DiGiancomo, G. *Migration (Ag. Cu. Pb) in Encapsulated Modules and Time-to-Fail Model as a Function of the Environment and Package Properties*, IEEE/PROC. IRPS, pp. 27–33 (1982).

*Primary Examiner*—Hassan Kizou
*Attorney, Agent, or Firm*—Fish & Richardson, P.C., P.A.

[57] ABSTRACT

In a security or monitoring system having a system roller and one or more sensor/transmitters, information is sent from the transmitter to the system controller in message packets. As improved message packet protocol provides a front porch pulse, a set of synchronization bits, a start bit, a set of information bits, a first stop bit, a set of error detection bits, and a second stop bit.

13 Claims, 46 Drawing Sheets

*Fig. 4A*

| | |
|---|---|
| Fig. 4A-1 | Fig. 4A-2 |

*Fig. 4B*

| | |
|---|---|
| Fig. 4B-1 | Fig. 4B-2 |
| Fig. 4B-3 | Fig. 4B-4 |

*Fig. 4C*

| | |
|---|---|
| Fig. 4C-1 | Fig. 4C-2 |
| Fig. 4C-3 | Fig. 4C-4 |

*Fig. 4D*

| | |
|---|---|
| Fig. 4D-1 | Fig. 4D-2 |
| Fig. 4D-3 | Fig. 4D-4 |

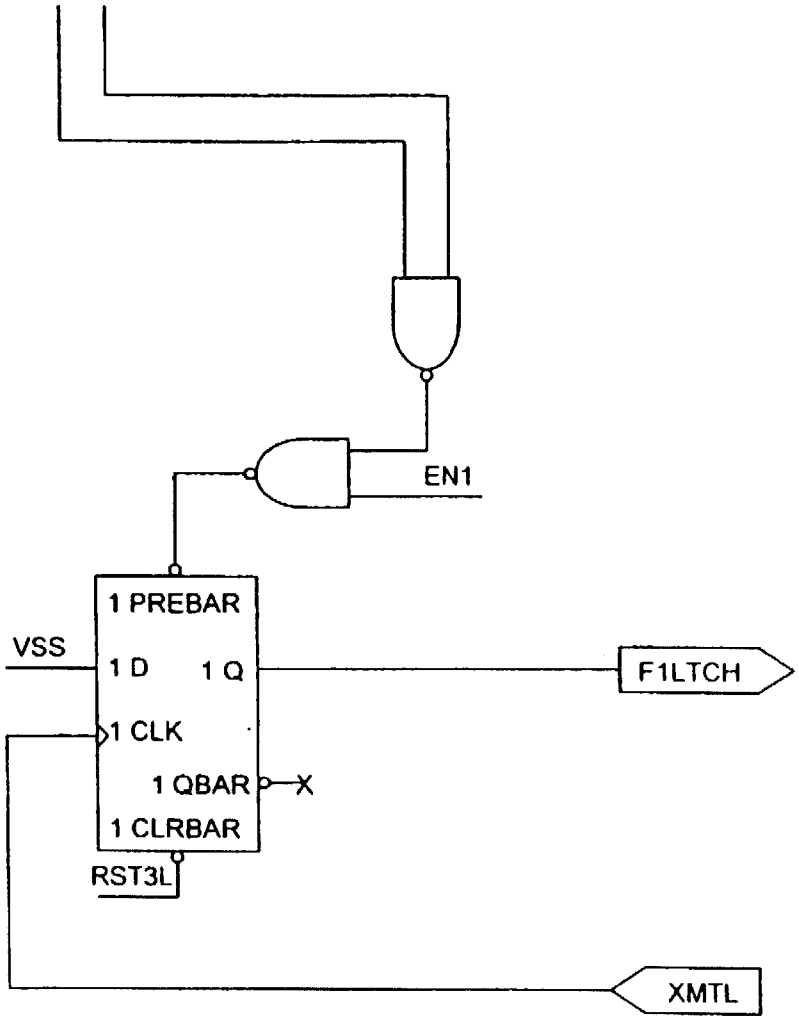
*Fig. 4B-4*
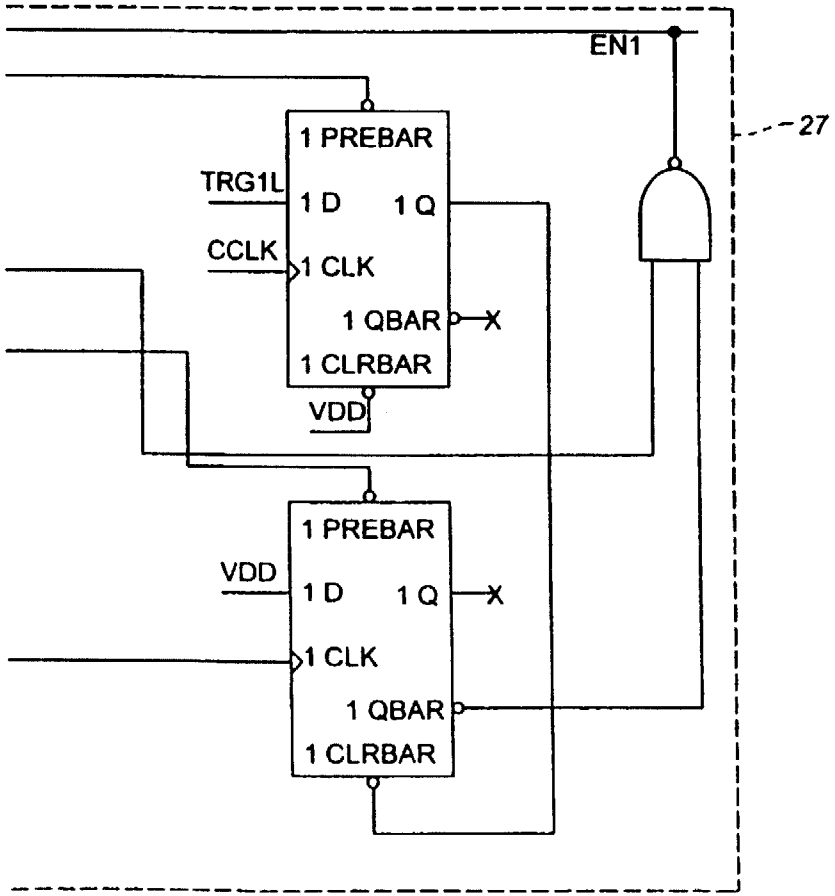

| | |
|---|---|
| FIG. 6A | FIG. 6B |
| FIG. 6C | FIG. 6D |
| FIG. 6E | FIG. 6F |

| | |
|---|---|
| FIG. 7A | FIG. 7B |
| FIG. 7C | FIG. 7D |

| | |
|---|---|
| FIG. 8A | FIG. 8B |
| FIG. 8C | |

| | | |
|---|---|---|
| FIG. 9A | FIG. 9B | FIG. 9C |
| FIG. 9D | FIG. 9E | FIG. 9F |
| FIG. 9G | FIG. 9H | FIG. 9I |
| FIG. 9J | FIG. 9K | |

MESSAGE PACKET PROTOCOL FOR COMMUNICATION OF REMOTE SENSOR INFORMATION IN A WIRELESS SECURITY SYSTEM

BACKGROUND OF THE INVENTION

This invention relates to a message packet protocol used in a wireless security or monitoring system having a system controller and a plurality of sensor transmitters.

Security or monitoring systems typically include a plurality of sensor/transmitters and a host or system controller. The communication link between the sensors and system controller can be hardwired or wireless. As shown in FIG. 11, a wireless system includes a plurality of sensor/transmitters 803 that communicate with the system controller 805. The system controller 805 may have a communication linked with central station 807, which in turn may contact, for example, a fire or police department, or even another electronic device such as a computer (not shown).

When one of the sensors is triggered by motion or other triggering event, sensor/transmitter 803 transmits one or more message packets to the system controller, thereby signaling a change in status of the sensor. Each message packet typically includes information about the nature of the alarm and the identity of the sensor/transmitter that generated the alarm. Depending on the information received, the system controller 805 instructs the central station 807 to take appropriate action in response, e.g., contacting the police.

In wireless systems, the transmitter may use pulse width modulation to communicate a digital message consisting of logical 1's and logical 0's. One such protocol for sending this digital information is disclosed in U.S. Pat. No. 4,855,713, assigned to the assignee of the present invention, Interactive Technologies Inc. The protocol disclosed in the '713 patent is a 58-bit message providing the basic information on the status of the input ports, the battery status, the sensor type and transmitter identification codes, and limited error detection for a particular sensor/transmitter 803.

There is a need for an improved message packet protocol that provides additional information.

SUMMARY OF THE INVENTION

In the present invention, a message packet protocol is provided for a wireless security system. The protocol includes a message packet of 64 bits of information. The bits provide initialization for the system controller, information regarding the sending transmitter and associated sensor, error detection, and stop bits.

Advantages of the invention include an enhanced message packet protocol for sending information from a transmitter to the system controller. The enhancements include a front porch or wake up pulse that allows the receiver associated with the system controller to synchronize with the incoming packet. Additionally, the 3-bit trigger count is provided to prevent third parties from recording the message packet and reusing the message packet to manipulate the system controller. Also, an additional programmable bit is provided that provides greater functionality and flexibility. Finally, in addition to parity techniques for error detection and reconstruction, an additional 3 bits provide a modulus 8 count of the number of 1's in bits 15 through 54, providing enhanced error detection information.

Other advantages and features will become apparent from the following description and claims.

DESCRIPTION OF THE PREFERRED EMBODIMENTS

Figure 1:
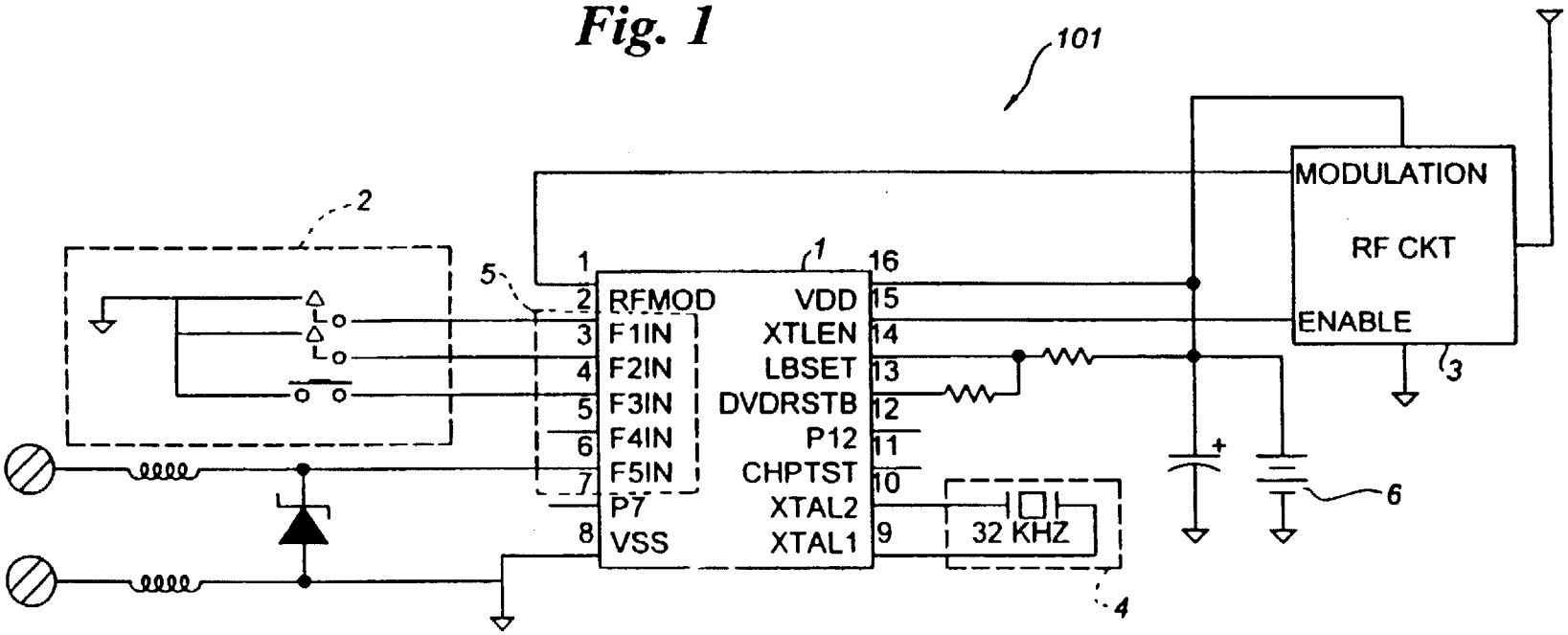
FIG. 1 is a block diagram of a wireless sensor system.

Referring to FIG. 1, a wireless sensor system 101 includes a single-chip transmitter 1 to which sensors, e.g., a door sensor 2 (e.g., model no. 60-362 available from Interactive Technologies Inc., North St. Paul, Minn.) may be connected. When the door opens or closes, the change in condition is detected at sensor inputs 5. Transmitter 1 responds to the change by generating a message, in packets, and sending them wirelessly via an RF modulation circuit 3 to a distant system controller (not shown). The system controller decodes the message, and determines whether to send an alarm to a monitoring station (also not shown). Transmitter 1 is clocked by a 32 kHz crystal 4. The system is powered by battery 6. Other kinds of sensors can be served, including window sensors, motion detectors, sound detectors, heat detectors, and smoke detectors.

Figure 2:
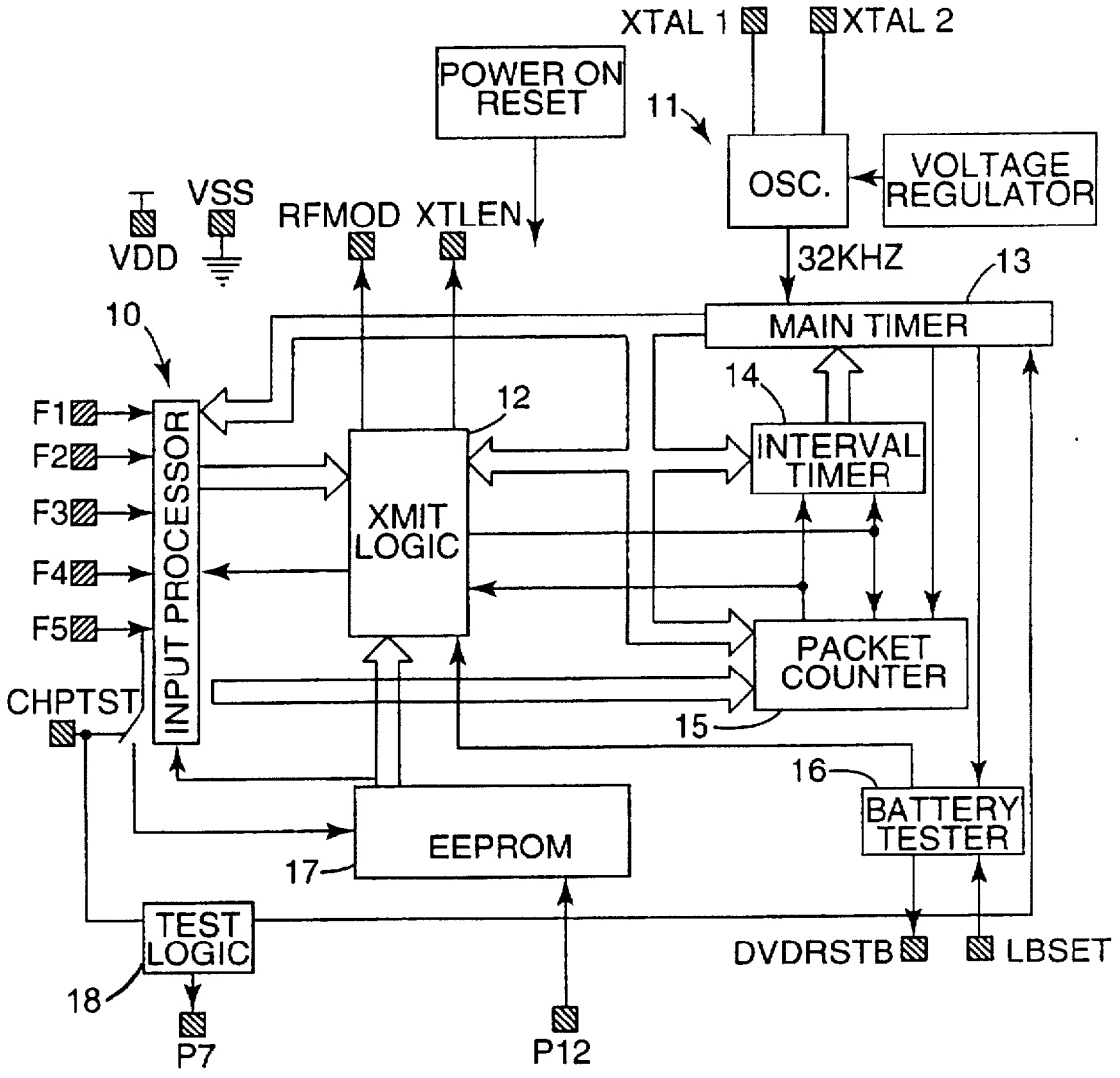
FIG. 2 is a block diagram of the single-chip transmitter of FIG. 1.

As shown in FIG. 2, the main functional components of transmitter 1 include: (1) sensor input processors 10; (2) transmission logic 12, which generates packets based on sensor inputs; (3) main timer 13, which receives clock ticks from a low power oscillator 11 and generates corresponding timing signals based on the external 32 kHz crystal 4; (4) interval timer 14 for generating pseudo-random intervals between successive packets; (5) packet counter 15 for counting the number of packets sent during a transmission; (6) battery tester 16 for testing the supply battery voltage; (7) EEPROM 17 for storing data and program information; and (8) test logic 18 for internal testing of the transmitter.

The five sensor inputs 5 appear at pins F1IN through F5IN of the transmitter 1. Each input 5 has an associated input processor 10. Input processors 10 are scanned simultaneously every 250 ms. Uninterrupted simultaneous sensing of all inputs would be impractical for a battery-powered sensor system in which the battery is expected to last for a relatively long period, e.g., five years or more.

A change in an input signal level (reflecting a change in the sensor condition) is disregarded unless it appears in two successive scan cycles. Therefore, an input signal change must be present for at least 250 ms to be accepted. Optionally, the scanning cycle may be reduced to 31 ms. The shorter scanning cycle is used in applications where a 250 ms scan is inconvenient for the system user, e.g., when a key fob is used to active/deactive a system.

Among the other pins of transmitter 1 is RFMOD which provides an output message to RF modulation circuit 3. Pin P7 provides an output of a low battery comparator associated with battery tester 16 when pin CHPTST is set to logic "1". VSS and VDD receive negative and positive supply voltage, respectively. XTLEN carries an enable signal to RF modulation circuit 3. LBSET carries a low battery threshold voltage input. DVDRSTB delivers a strobe divider output. Pin P12 receives an EEPROM programming shift clock. CHPTST receives a chip test input signal. XTAL1 and XTAL2 are connected to 32 kilohertz (kHz) crystal 4.

Input scanner 11 receives several clock signals from main timer 13, including DCLKL, KCLK, NCLK, and BCLK. Input scanner 11 also receives signal FSCAN which corresponds to bit EP31 in EEPROM 17. FSCAN controls the scan cycle; when FSCAN is a logic "0" the scan cycle is 250 ms, and when FSCAN is a logic "1" the scan cycle is 31 ms.

Figure 3A:
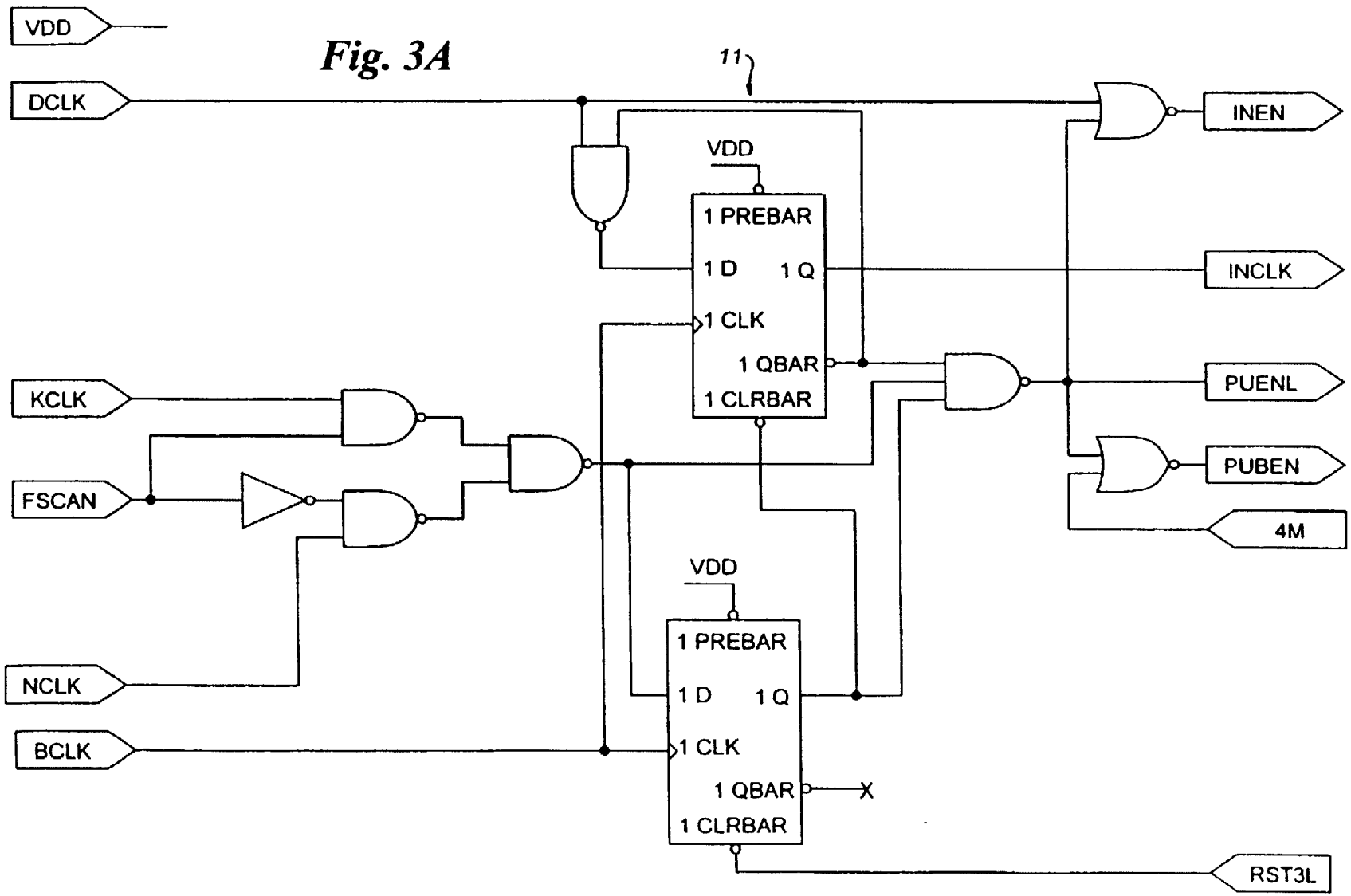
FIG. 3A is a block diagram of an input scanner.
Figure 3B:
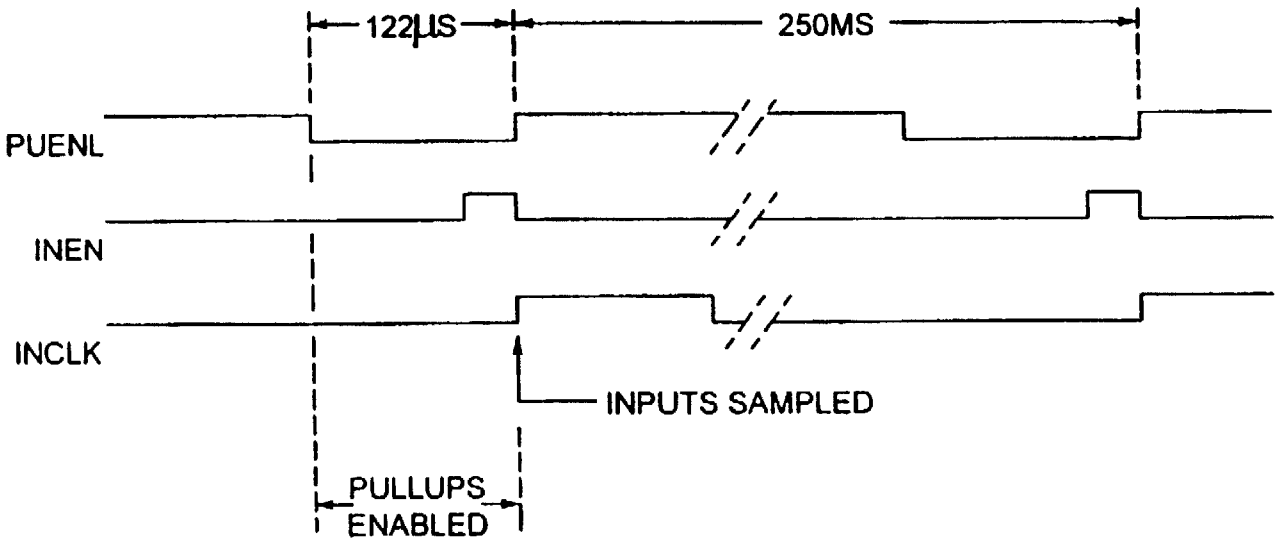
FIG. 3B is a timing diagram for the input scanner.

As shown in FIG. 3A, input scanner 11 generates four output signals, INEN, INCLK, PUENL, and PUBEN to control the detection of inputs 5 by their respective input processors 10. As shown in FIG. 3B, just before the beginning of a scanning cycle, PUENL goes low (logical 0) for about 122 μs to allow any transitional signals (caused by capacitance or noise) to settle. The beginning of the cycle is signaled when INEN goes to a logical 1. At the start of the cycle INCLK goes high and stays high while inputs are being scanned. All inputs are scanned simultaneously.

Figures 1, 4A:
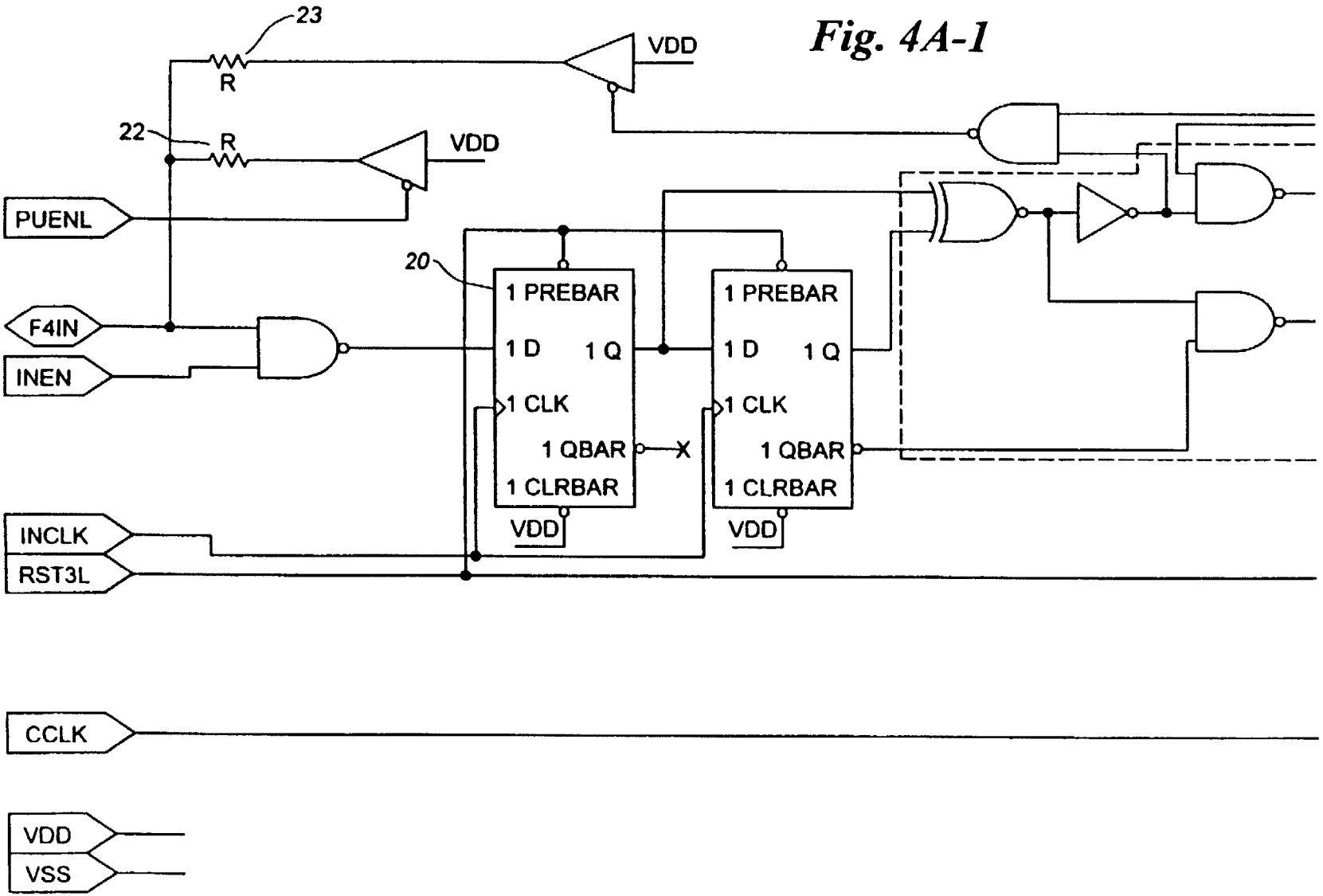
FIGS. 4A through 4D are block diagrams of input processing circuits for four inputs of the transmitter.
Figures 2, 4A:
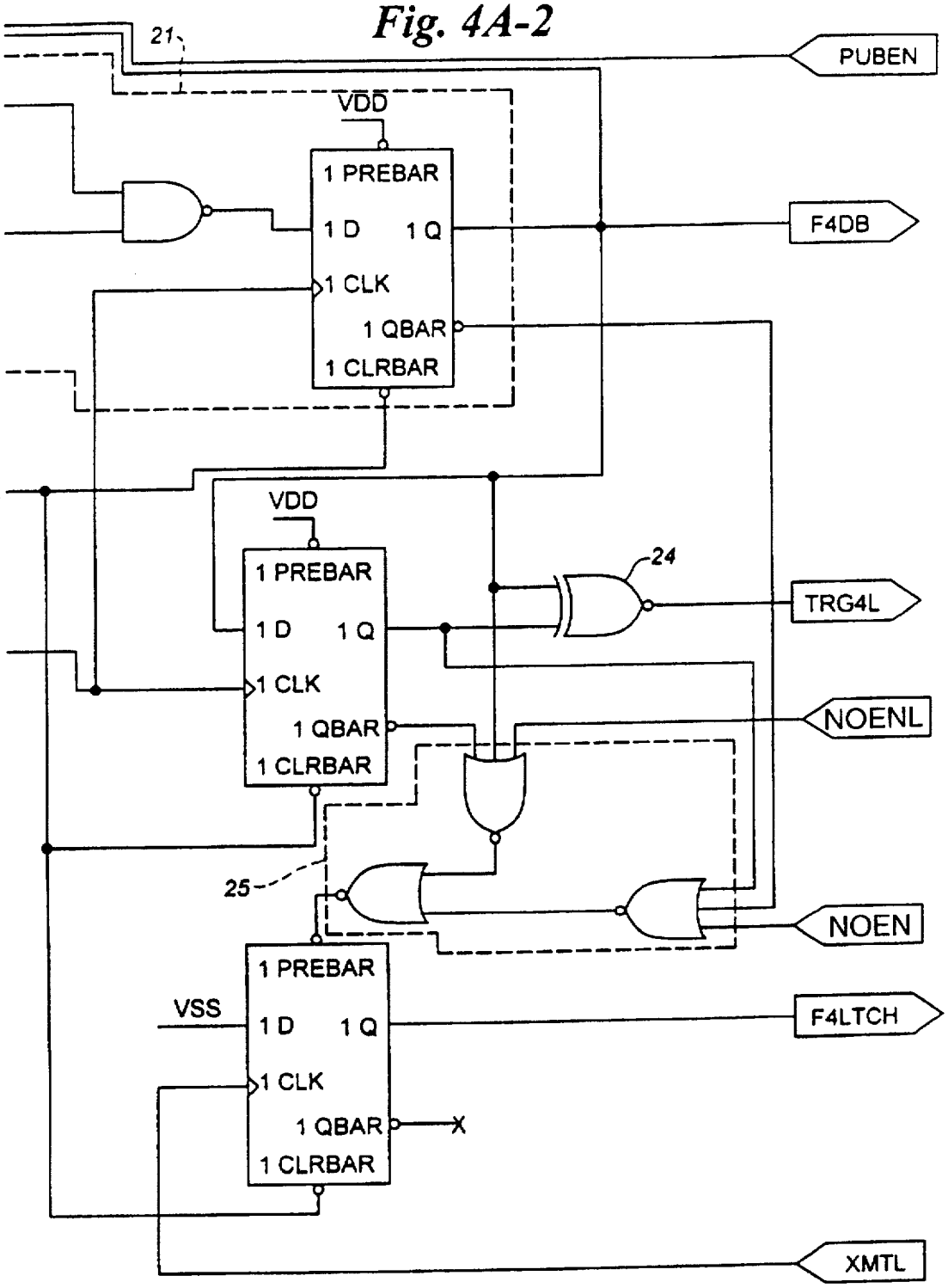

As shown in FIG. 4A, INEN is gated with sensor input signal F4IN. On the rising edge of INCLK, the gated F4IN signal is latched into flip-flop 20. The latched input signal is then processed by debounce circuitry 21 to yield debounced signal F4DB as an output.

Figures 1, 4B:
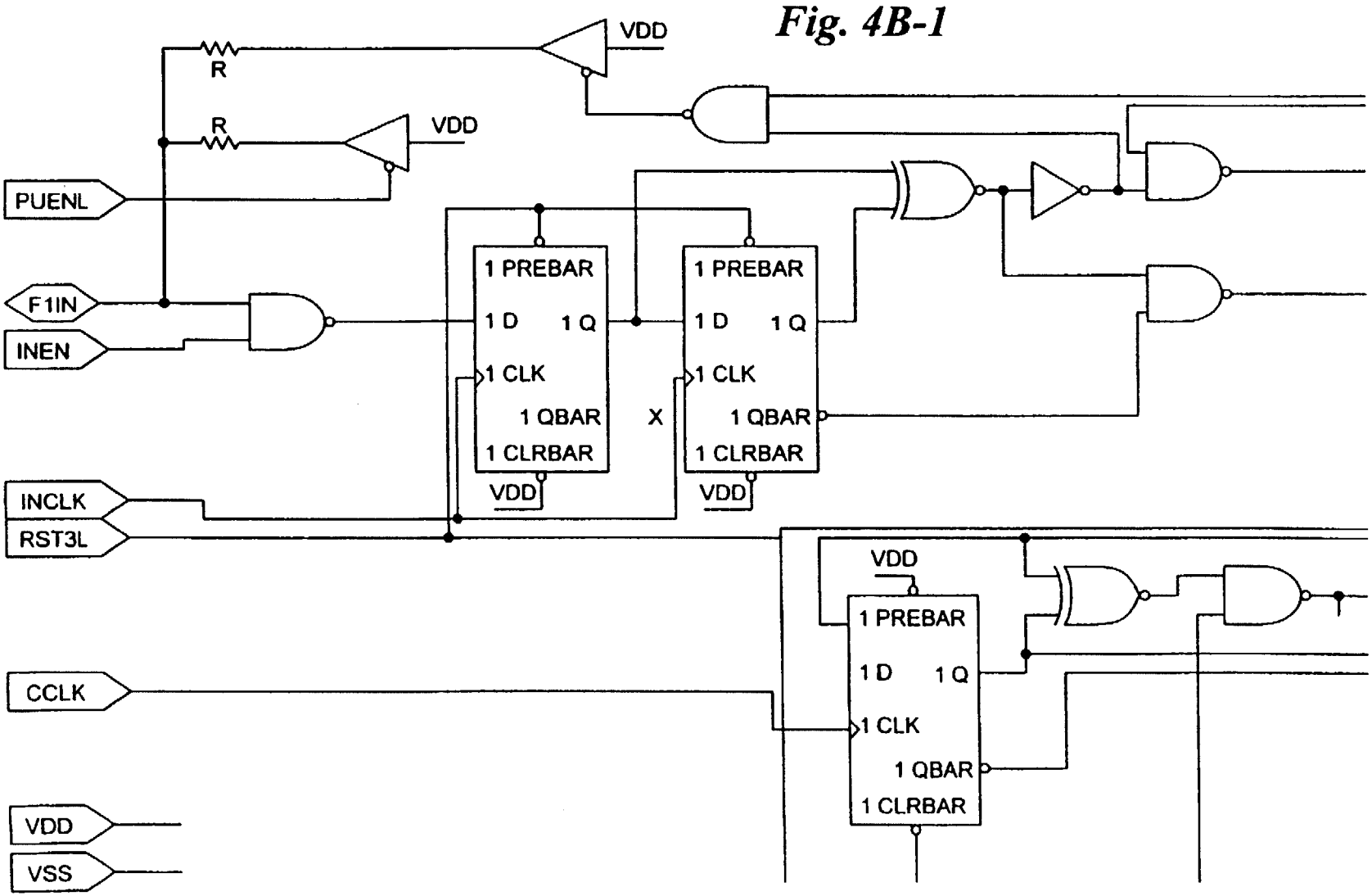
Figures 2, 4B:
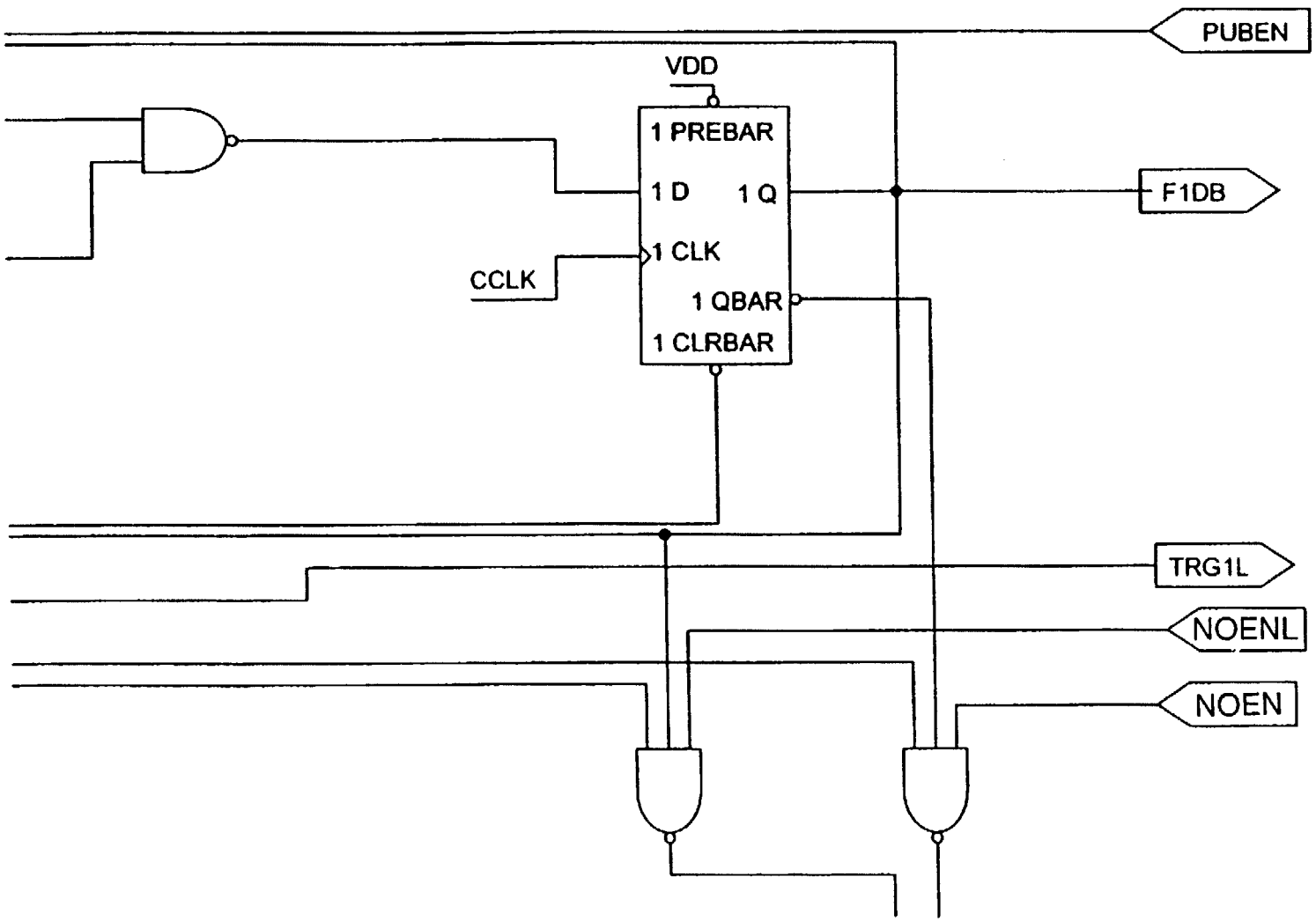
Figures 3, 4B:
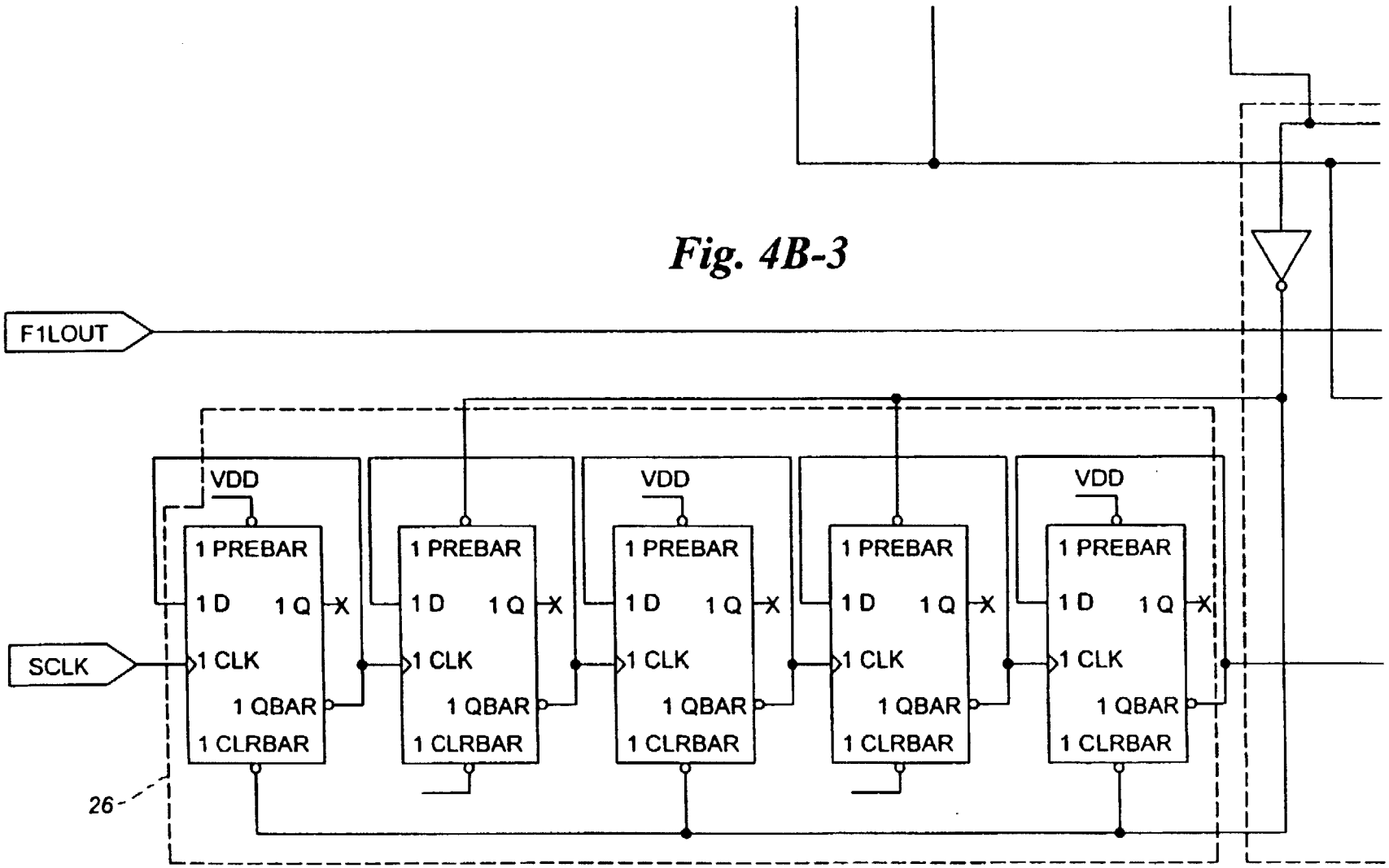
Figures 1, 4C:
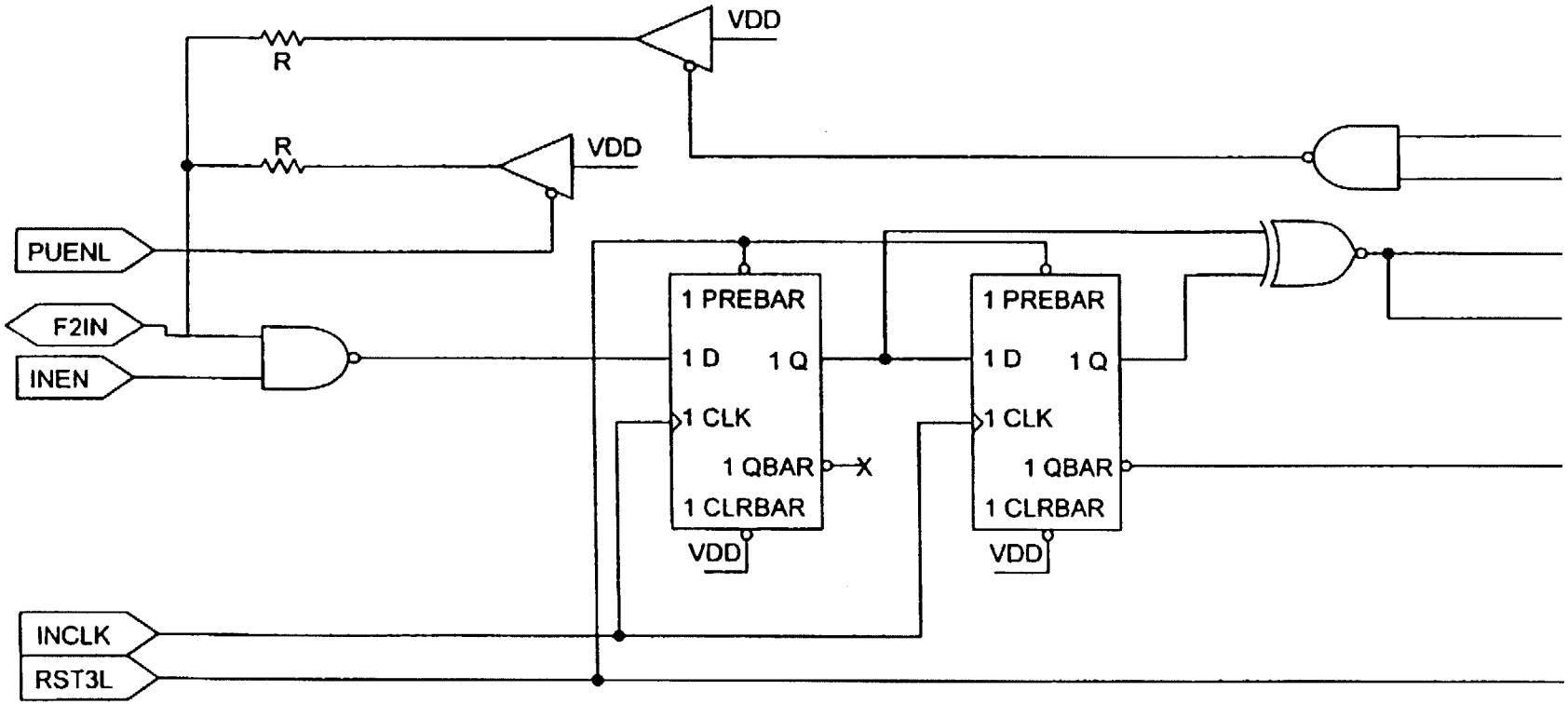
Figures 2, 4C:
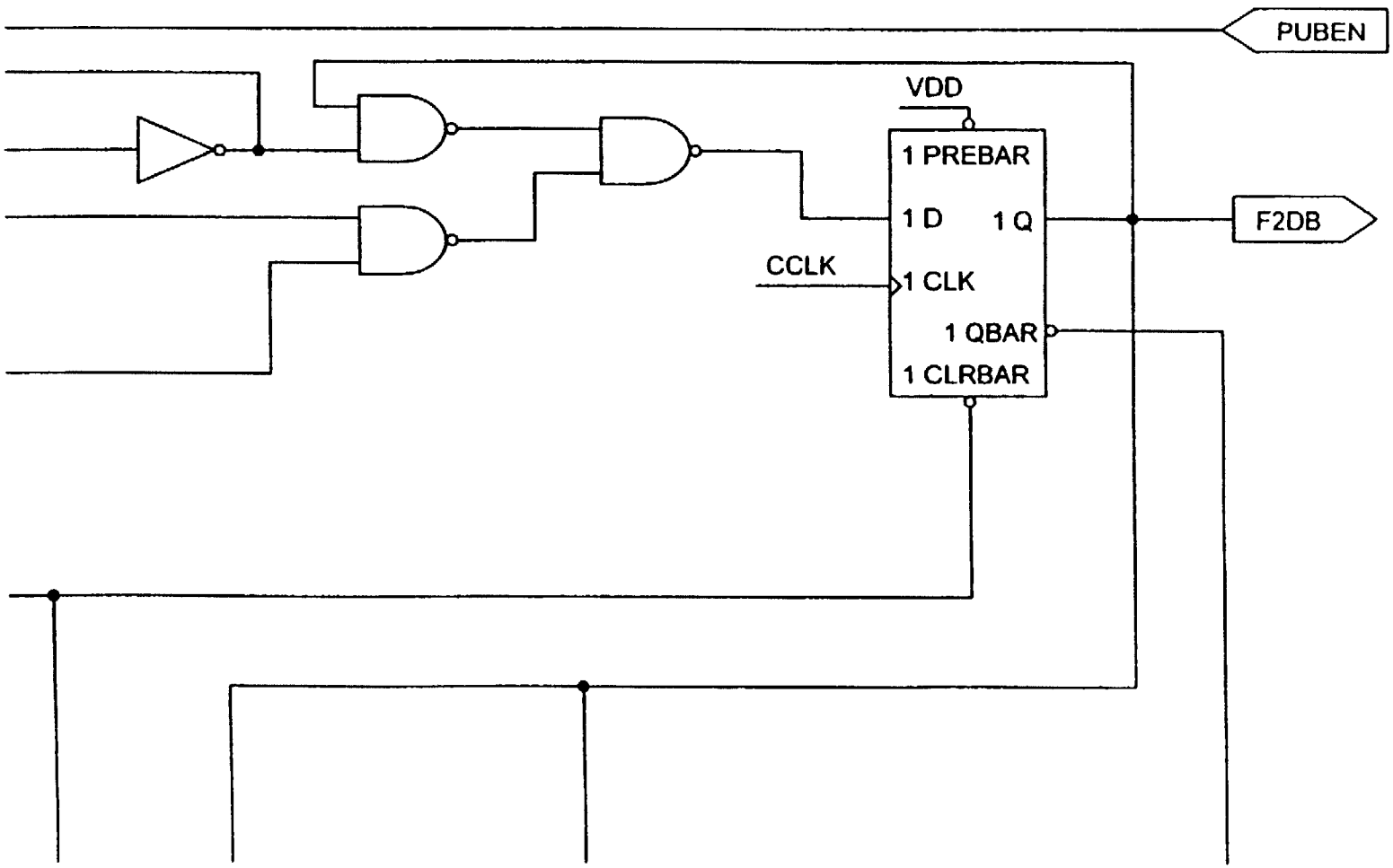
Figures 3, 4C:
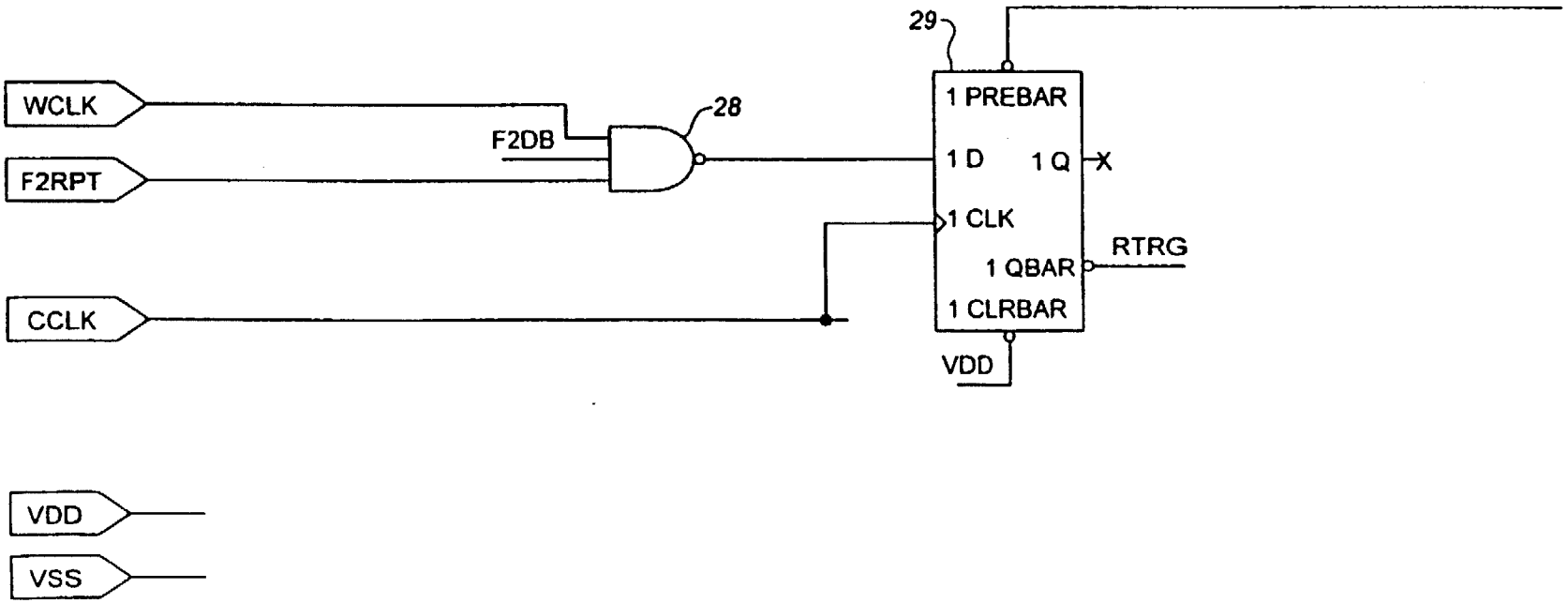
Figures 4, 4C:
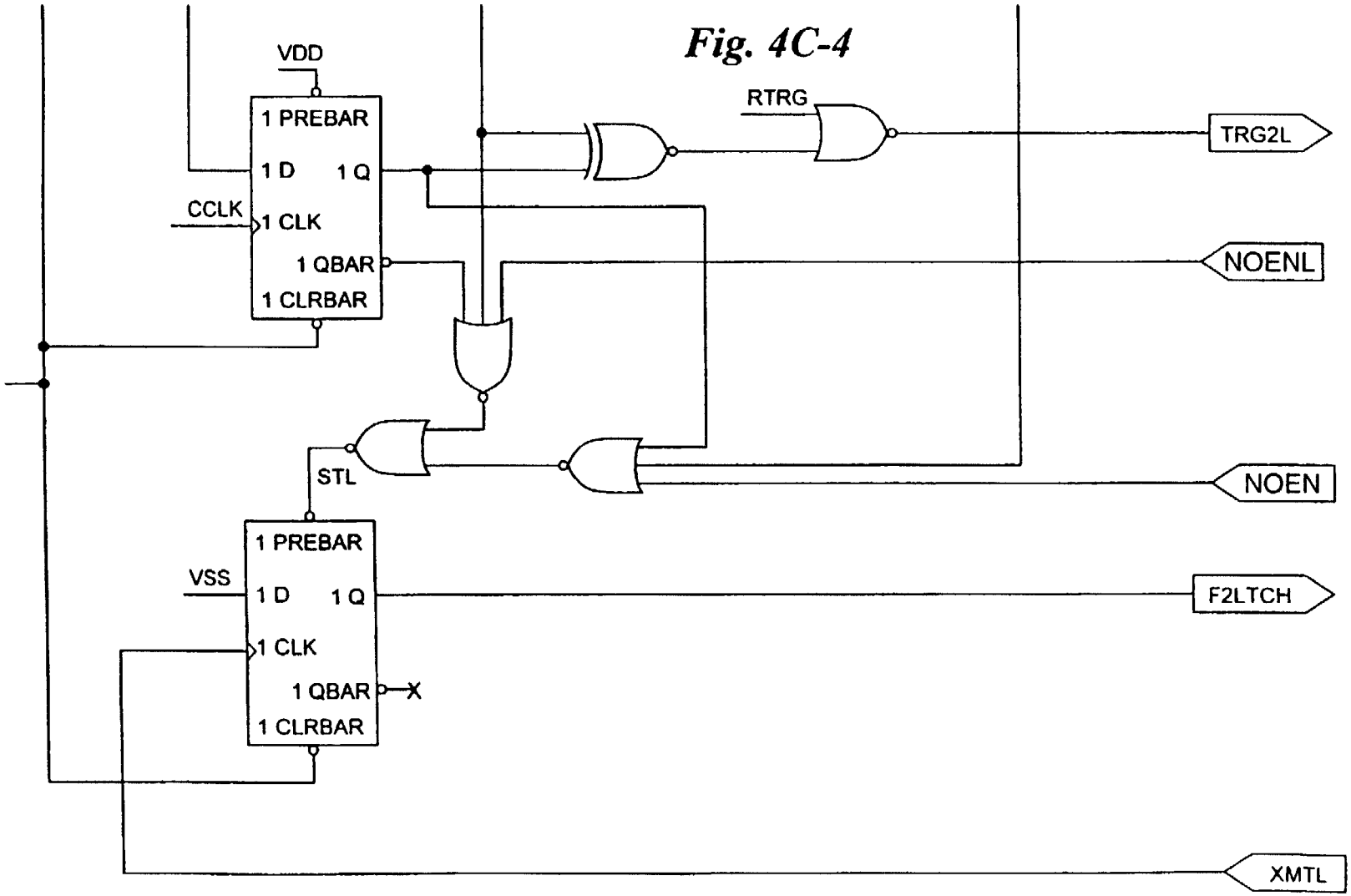
Figures 1, 4D:
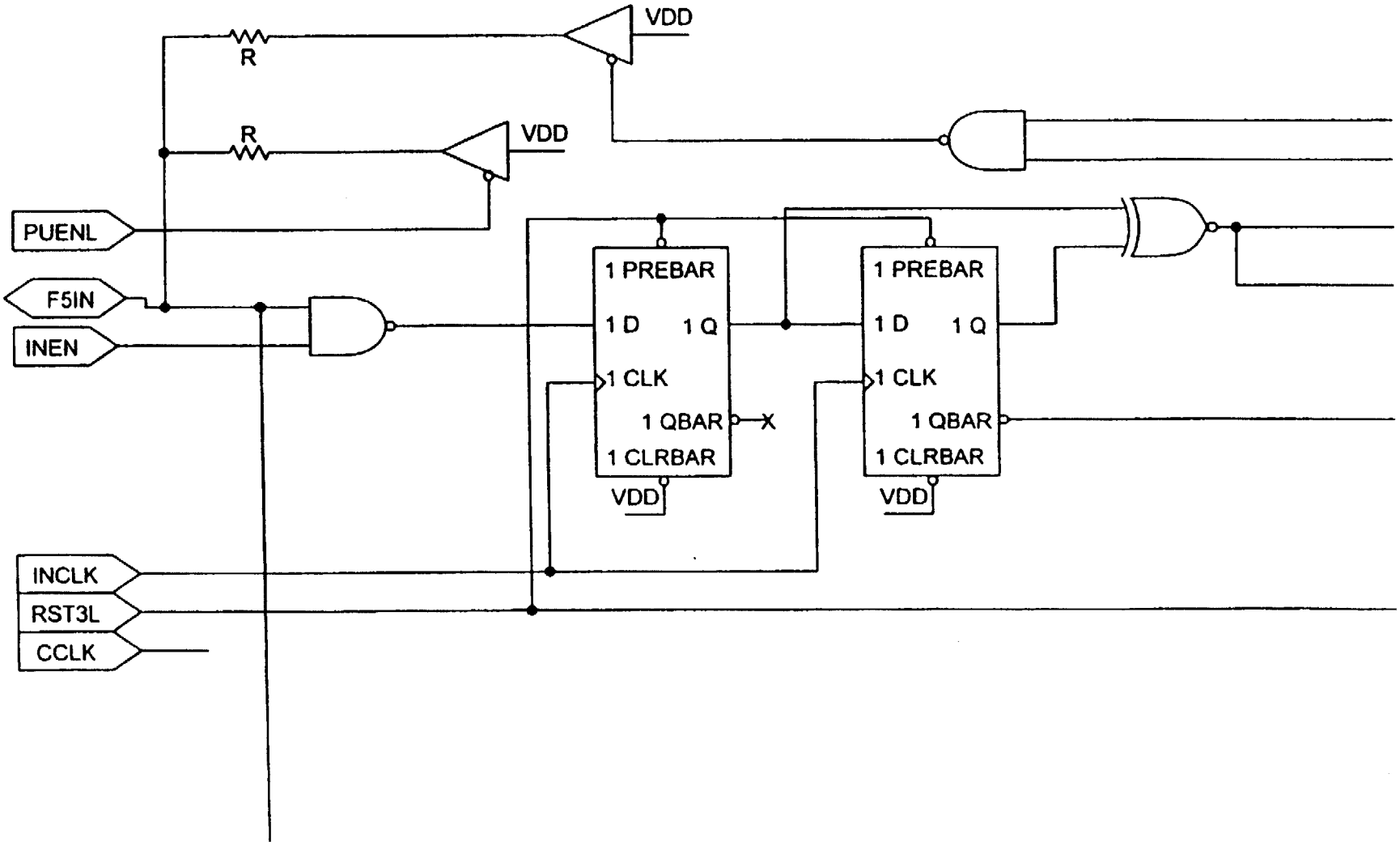
Figures 2, 4D:
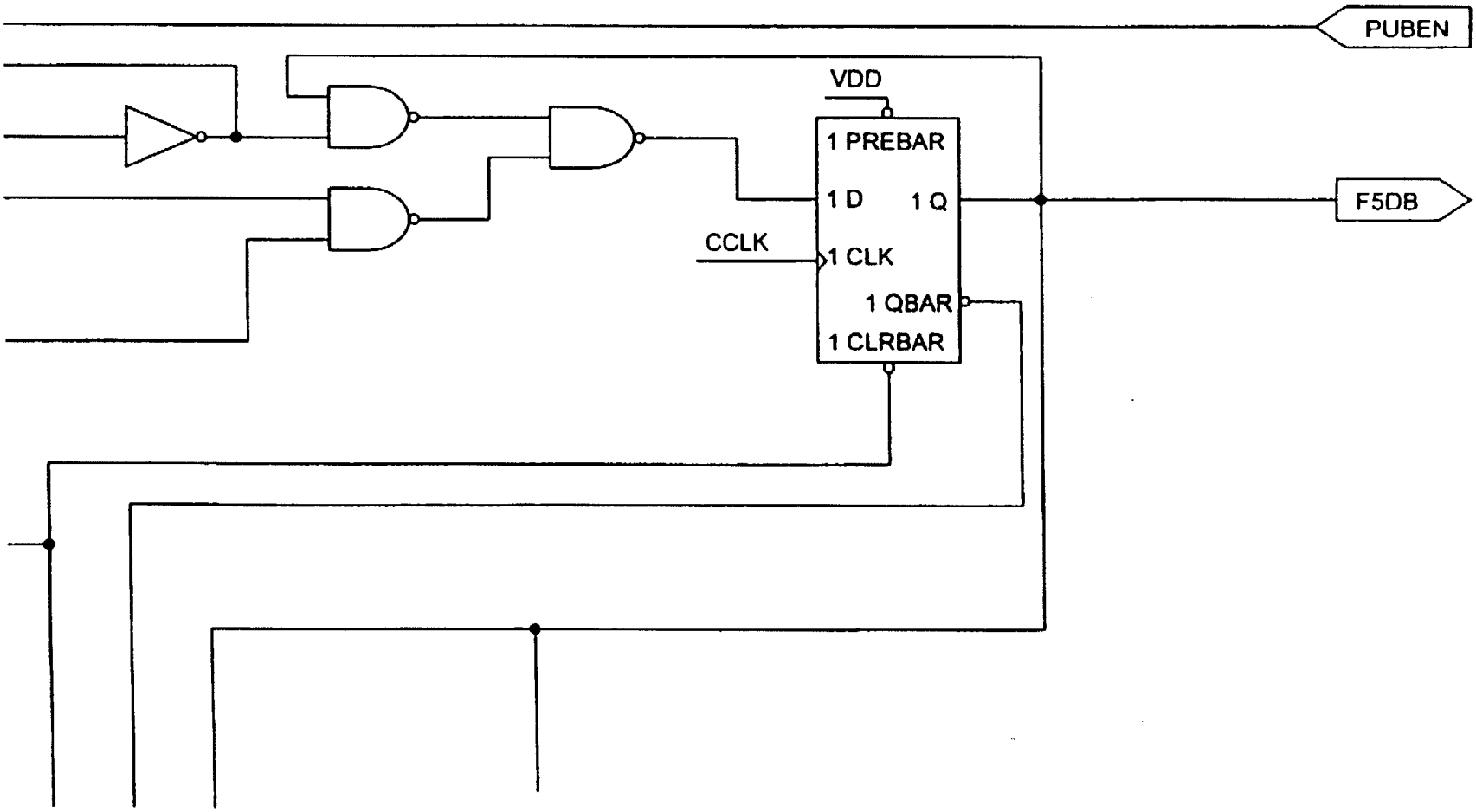
Figures 3, 4D:
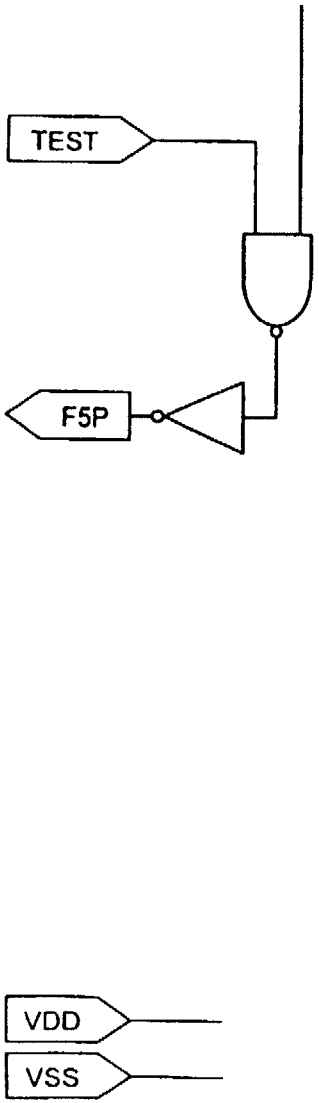
Figures 4, 4D:
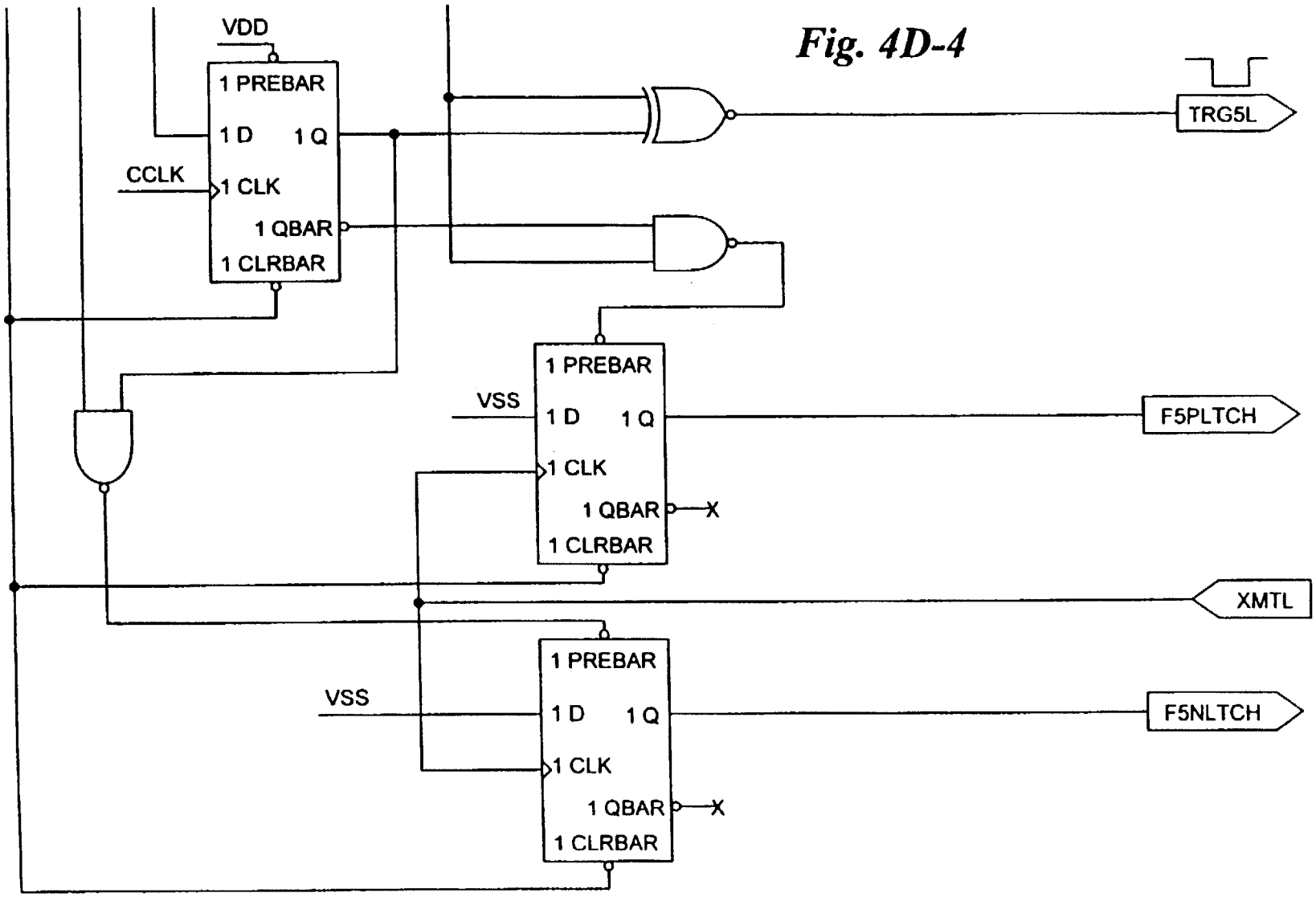

The input processors 10 for input signals F1IN, F2IN, and F5IN are shown in FIGS. 4B through 4D; the input processor for input signal F3IN is the same as in FIG. 4A. FIGS. 4B through 4D show additional processing circuitry that is specific to the associated input pins. In alternative implementations, the input processor for any given pin could have selected features from any of the FIGS. 4A–4D.

During scanning, the input pin is connected via a pull-up resistance to a voltage source VDD. As seen in FIG. 4A, this is accomplished by signal PUENL which switches in a relatively large (roughly 24k ohm) pull-up resistance 22 (a resistor or a transistor); the larger resistance value causes a smaller current, thereby reducing battery drain. To reduce dendrite build-up, each input processor 10 includes a second smaller pull-up resistor 23 (roughly 5k ohm). The larger current resulting from smaller pull-up resistor 23 reduces or blows away dendrite short circuits that may be forming on the traces of the circuit board connected with the input pins.

The development of parasitic parallel resistances, such as dendrite build-up on the circuit board, may cause an input processor 10 to initiate the generation of message packets indicating a change in condition, when no such change has actually occurred. For example, a door sensor 2 indicates whether the door is open (seen at the input pin as a logical 1) or closed (seen at the input pin as a logical 0). When the door is open, different voltage potentials exist between the copper traces on the circuit board. Dendrite particles on the circuit board are attracted to the voltage differential and can form a short circuit from trace to trace.

The short circuit causes a logical 0 to appear at the input pin. To the input processor 10, this looks the same as if the door sensor 2 has gone from an open-to-closed condition. Transmitter 1 will then send a message containing incorrect information. Once the dendrite-induced short circuit is established, it is possible that the door may be opened and closed numerous times without the transmitter 1 generating and sending packets which reflect the actual changes in condition.

Dendrite short-circuits and other types of parasitic parallel resistance are eliminated or overcome by using two pull-up resistors 22, 23. The first pull-up resistor 22 is normally used to switch in the power supply when the input processors 10 are scanned. The resistance value of pull-up resistor 22 is selected to activate the circuit with a low current, thereby conserving the battery. However, the current generated by pull-up resistor is not sufficient to destroy or overcome a dendrite-induced short circuit. Therefore, if a change of condition is detected, e.g., the signal at the input pin goes from logical 1 to logical zero, a second pull-up resistor 23 is used to switch in the battery. The resistance value of pull-up resistor 23 is selected to generate a current sufficient to destroy or overcome dendrite-induced short circuits. This two-resistor scheme eliminates or reduces false information from being generated by transmitter 1 (by selectively using a high current) without significantly increasing the energy requirements (by normally using a low current).

As discussed above, each input processor 10 is scanned about once every 250 msec. In addition to reducing the energy requirements of the transmitter, scanning helps reduce dendrite build-up in two ways. First, periodic scanning as opposed to a constant scan greatly reduces the time period when voltage differentials exist, thereby reducing the conditions under which dendrite short circuits form. Second, periodic scanning allows for larger currents on each scan. The larger currents are more likely to destroy dendrite build-up.

During scanning, the input pin is connected via a pull-up resistor to a voltage source VDD. As seen in FIG. 4A, this is accomplished by signal PUENL, which switches in either a relatively large (roughly 24k ohm) pull-up resistor 22 (a resistor or a transistor), or a relatively smaller, second pull-up resistor 23 (roughly 5k ohm). During periods when no change in condition occurs, relatively large pull-up resistor 22 is used to switch in voltage source VDD. The larger resistance value creates a smaller current, reducing the drain on the transmitter battery 6. This smaller current may have little or no effect on short circuits created by dendrite build-up.

If a change of condition is detected between scan cycles (e.g., logical 1 to logical 0), the smaller pull-up resistor 23 is used to switch in voltage source VDD on the next scan cycle. The smaller pull-up resistor 23 creates a larger current sufficient to destroy or overcome dendrite short circuits. In another embodiment, the small pull-up resistor 23 is used to switch in VDD immediately upon a change in condition.

If dendrite build-up has created a short circuit, the input processor will detect a change of condition from open to closed (logical 1 to logical 0). On the next scan cycle, smaller pull-up resistor 23 is connected with voltage source VDD and the larger current destroys the short circuit. The input processor will now detect a change in condition from closed to open (logical 0 to logical 1). Therefore, input processor 10 will not generate a TRGxL signal (discussed below) and the transmitter 1 will not generate message packets indicating a change in condition because a change in condition has not been detected for two consecutive scan cycles.

As discussed above, in another embodiment, the small pull-up resistor 23 is used to switch in VDD immediately upon a change in condition, as opposed to waiting for the next scan cycle. Therefore, at the end of the scan, after smaller pull-up resistor 23 is used to destroy the dendrite short circuit, the condition detected by input processor 10 will be the same as the previously detected condition.

The smaller pull-up resistor 23 is not used on every scan cycle because it will drain the battery more rapidly than resistor 22. As discussed above, it is important to maximize the life of battery 6 associated with wireless transmitter 1. Therefore, in the present invention, the smaller resistor 23 is only switched into the circuit when a change in condition has first been detected by a larger resistor, e.g., resistor 22. Limiting the use of smaller resistor 23 extends the battery life while at the same time preventing or reducing incorrect information being sent to the system controller due to dendrite-induced short circuits.

As an example, one can compare three ways to energize input processor 10. First, a non-pulsed, single pull-up resistor can be used. Second, a pulsed, single pull-up resistor can be used. Finally, the pulsed, 2-stage resistance of the present invention can be used. In the first case, the pull-up current (I) must be minimized to maintain a suitably long battery life, e.g., 1μ amp, limiting the battery draw 1μ amp. The parasitic parallel resistance at failure (0.5 V/I) is about 1.8 MΩ. Therefore, this circuit is very sensitive to parasitic parallel resistance.

In the second case, using the scanning sequence disclosed above, a larger pull-up current I, e.g., 150μ amps, can be used, while decreasing the battery draw (due to scanning) to 0.075μ amps. The parasitic parallel resistance at failure is now about 12KΩ.

In the third case, i.e., the present invention, the second pull-up resistor generates a larger current, e.g., 750μ amps. The normal battery draw is still about 0.075μ amps. However, when the second resistor is used, the parasitic parallel resistance at failure is now about 2.4KΩ. Therefore, a circuit that implements the two resistor scheme is much less susceptible to parasitic parallel resistance.

In one embodiment, pull-up resistor 23 is used following any detection of a change in condition, i.e., open-to-closed or closed-to-open. In another embodiment, pull-up resistor 23 is used only when the change in condition is open-to-closed.

An additional feature to balance the requirements of battery conservation and dendrite reduction is the use of a lockout period. Once the smaller pull-up resistor 23 is used in a scanning cycle, pull-up resistor 23 is not used for a predetermined time period. The time period is selected to balance battery conservation with the likelihood of dendrite build-up. In one embodiment, the lockout period is about 4.25 minutes.

The lockout feature is implemented as shown in FIG. 3A by generating signal PUBEN, enabled by signal 4M from packet counter 15.

The selective use of pull-up resistors can be used to overcome other types of short circuits in addition to dendrite-induced short circuits. There are various situations where a short circuit can unexpectedly develop between parallel resistors. In many of these instances it would be advantageous to switch in a higher current that can eliminate or overcome a short circuit once a possible short circuit is identified by a current more suitable to normal operating conditions.

Among the other signals received by input processor 10 are CCLK, from main timer 13, which provides a 122 μs clock pulse, NOEN and NOENL which both derive from bit EP27 in EEPROM 17, and determine whether the latched input signal FxLTCH is set on a low-to-high input signal transition (for sensors that are normally closed) or on a high-to-low signal transition (for sensors that are normally open). Signal XMTL is generated from packet counter 15 and resets the latched input signal FxLTCH at the end of a message transmission.

Each debounced signal FxDB is fed to gate 24, along with a timing pulse derived from CCLK, to generate signal TRGxL that triggers both transmission logic 12 and packet counter 15. Debounced input signal FXDB is also processed by gates 25 to generate latched input signal FxLTCH.

As shown in FIG. 4B, the input processor for pin F1IN includes a lock-out timer which is used with a sensor of the kind that triggers constantly during certain periods (e.g., a passive infrared motion detector). The lock-out timer reduces the volume of messages, saving the battery. The lock-out function is enabled by signal F1LOUT from EEPROM 17, bit EP24. Flip-flops 26 form a 168 second (approximately) timer using SCLK as a clock input. Lock-out circuit 27 disables signals TRG1L and F1LTCH for about 168 seconds after a TRG1L signal.

As shown in FIG. 4C, input processor 10 for input pin F2IN includes a repeater function which is useful with critical sensors such as a smoke detector. The repeater function is achieved using gate 28 and flip-flop 29. Gate 28 has as inputs WCLCK (clock ticks appearing every 64 seconds), debounced signal F2DB, and the repeater enable signal F2RPT from EEPROM 17, bit EP26. This circuit initiates signal TRG2L every 64 seconds, causing generation of another group of message packets. Thus, as long as a sensor active signal is detected, i.e., pin F2IN is high, the system controller will receive the sensor message approximately every minute and will send repeated alarm messages to the monitoring station.

As shown in FIG. 4D, input processor 10 that serves pin F5IN includes elements that latch the debounced signal F5DB on both the rising and falling edges of the signal transition F5PLTCH and F5NLTCH, respectively. This configuration provides flexibility by accepting sensors that are in a normally open or closed state.

Each message generated by transmitter logic 12 is configured as a sixty-four bit data packet. Normally a series of eight identical data packets are transmitted for each qualified input signal change to assure that the system controller will reliably receive the message notwithstanding battery drain, overloading of the system by messages coming into the system controller, and other factors. If transmitter 1 is re-triggered by a sensor signal change while a group of packets is already being transmitted, the ongoing transmission of that group of packets is completed, then eight more packets are transmitted with the newer data.

Optionally, transmitter 1 may generate a group of only four packets for each qualified signal change during periods of frequent sensor triggering as a way to reduce battery drain. After the first series of eight packets is sent, if a subsequent input change is detected within 4.25 minutes of the end of the last packet transmission, then only four packets are sent. Otherwise, eight packets are sent.

Each packet carries sensor data and identification and includes sixty-four bits:

| Bits | Description |
|---|---|
| 00–02 | 976 μs RF front porch pulse |
| 03–14 | 12 sync pulses, logical zeros |
| 15 | start pulse, logical one |
| 16–35 | 20 bit sensor identification code (ID bits 0–19) |
| 36–39 | 4 bit device type code (DT bits 0–3) |

-continued

| Bits | Description |
|---|---|
| 40–42 | 3 bit trigger count (TC bit 0–2) |
| 43 | low battery bit |
| 44 | F1 latch bit |
| 45 | F1 debounced level |
| 46 | F2 latch bit |
| 47 | F2 debounced level |
| 48 | F3 latch bit |
| 49 | F3 debounced level |
| 50 | F4 latch bit |
| 51 | F4 debounced level |
| 52 | F5 positive latch bit |
| 53 | F5 debounced level |
| 54 | F5 negative latch bit |
| 55 | even parity over odd bits 15–55 |
| 56 | odd parity over even bits 16–56 |
| 57 | zero/one, programmable |
| 58 | RF on for 366 μs (old stop bit) |
| 59 | one |
| 60–62 | modulus 8 count of number of ones in bits 15–54 |
| 63 | zero (new stop bit) |

Bits 00 to 02 are a 976 ms RF front porch pulse, providing a wake up period that allows the system controller receiver to synchronize with the incoming packet. Bits 3 to 14 include 12 sync pulses, e.g., logical 0's, to synchronize the receiver. Bit 15 is a start pulse, e.g., a logical 1, that tells the receiver that data is to follow.

Bits 16–58 provide information regarding the transmitter and associated sensor. In other embodiments, bits 16–58 may be replaced by an analog signal.

Bits 16 to 35 provide a 20-bit sensor identification code that uniquely identifies the particular sensor sending the message. Bits 36 to 39 provide a 4 bit device-type code that identifies the specific-type of sensor, e.g., smoke, PIR, door, window, etc. The combination of the sensor bits and device bits provide a set of data bits.

Bits 40 through 42 provide a 3-bit trigger count that is incremented for each group of message packets. The trigger count is a simple but effective way for preventing a third party from recording a message packet transmission and then re-transmitting that message packet transmission to make the system controller think that a valid message packet is being transmitted.

Bit 43 provides the low battery bit.

Bits 44 through 53 provide the latch bit value and the debounced value for each of the five inputs associated with the transmitter. For the F5 input, both a positive and negative latch bit are provided.

Bit 55 provides even parity over odd bits 15 to 55. Bit 56 provides odd parity over even bits 16 to 56. Bit 57 is a programmable bit that can be used for a variety of applications, including providing an additional bit that could be used for the sensor identification code or device type code.

Bit 58 is a 366 ms RF on signal that functions as the "old" stop bit. This bit provides compatibility with prior system controllers that may be programmed to receive a 58-bit message.

Bit 59 is a logical 1. Bits 60 to 62 are a modulus eight count of the number of 1 bits in bits 15 through 54, providing enhanced error detection information to be used by the system controller. Finally, bit 63 is the "new" stop bit, e.g., a logical 0, that tells the system controller that it is the end of the message packet.

Figure 5A:
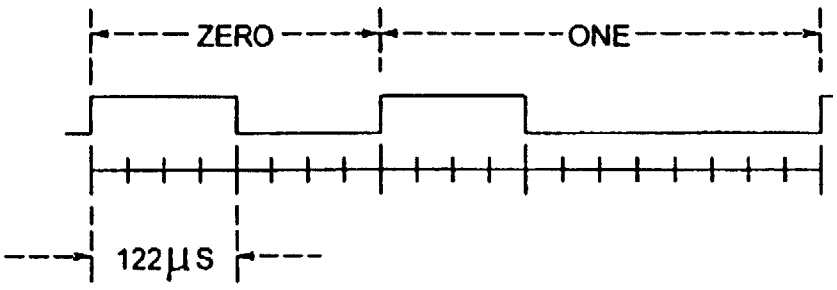
FIG. 5A is a timing diagram of bit values.
Figure 5B:
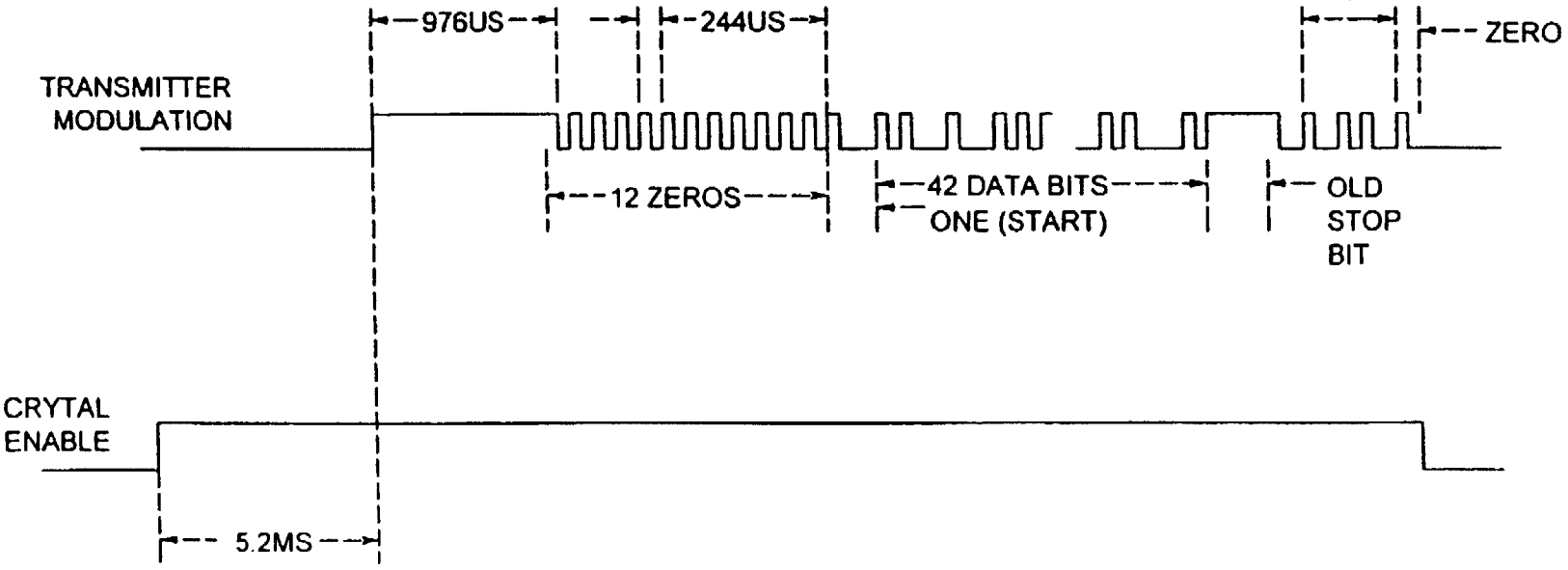
FIG. 5B is a timing chart of a packet.

As shown in FIG. 5A, transmitter 1 uses pulse-width modulation to generate logical 1's and 0's. A 1 bit has 122 μs RF on and 244 μs RF off, a 0 bit has only 122 μs RF off. As shown in FIG. 5B, crystal enable pin, XTLEN, goes high approximately five ms before the start of each packet transmission and remains high until the end of the packet transmission.

The interval between successive packets in a group is varied pseudo-randomly from about 93 ms to 453 ms.

If about an hour elapses without a packet transmission, the main timer 13 will automatically cause transmitter 1 to send three, identical supervisory data packets each having the same configuration as for other packets. The quiet interval which ends in the supervisory packets being sent is varied in a pseudo-random manner from about 64 minutes to 68 minutes. Alternatively, the supervisory signals may be sent after a quiet period of only sixty-four seconds. The sixty-four second supervisory is used in high security applications, e.g., home incarceration.

EEPROM 17 stores 36 control bits. Bits EP00 to EP19 provide 20 sensor identification code bits. Bits EP20 to EP23 provide four device type bits (e.g., 0101 for a smoke detector). Bits EP32 to EP34 provide three band gap accuracy trim bits used with battery tester 16.

EEPROM bits EP24 to EP31 provide programming options. When EP24 is set to logical 1, it enables the three minute lock-out function as described above regarding FIG. 4B. When EP25 is set to logical 1, the supervisory interval is shifted from approximately one hour to sixty-four seconds. When EP26 is set to logical 1, the repeater function will trigger data transmissions every sixty-four seconds. When EP27 is set to logical 0, the input latch signals FxLTCH are set on the low to high input signal transition. For EP27 set to logical 1, the input latch signals FxLTCH are set on the high to low input transition.

EP28 controls the number of packets transmitted for each sensor trigger (logical 0 yields eight packets per group; logical 1 yields eight packets for more than 4.25 minutes from the end of the last packet transmission, otherwise only four packets).

When EP29 is logical 1, bits 60 to 63 of the packet are not transmitted, making the transmitter compatible with sixty bit systems. EP30 controls the value of bit 57. Bit 57 can be used as an additional bit to identify the device type. EP31 set to logical 1 increases the input scan cycle rate to 32 scans per second. When EP35 is set to logical 1, transmitter 1 delivers a 32 kHz signal on pin P7, otherwise 32 Hz.

The EEPROM is programmed by serial input. Pin CHPTST is set to logical 1. The EEPROM data is then serially entered on pin F5IN while a shift clock (PRGCLK) is delivered at pin 12. The data is shifted on the rise of each clock pulse. The serial data bits are preceded by a logical 1 followed by the program bits PB00 through PB35. Transmitter 1 begins EEPROM programming when it detects that the leading logical 1 has reached the end of the EEPROM 17 shift register.

Figures 6, 7, 8, 9, 10:
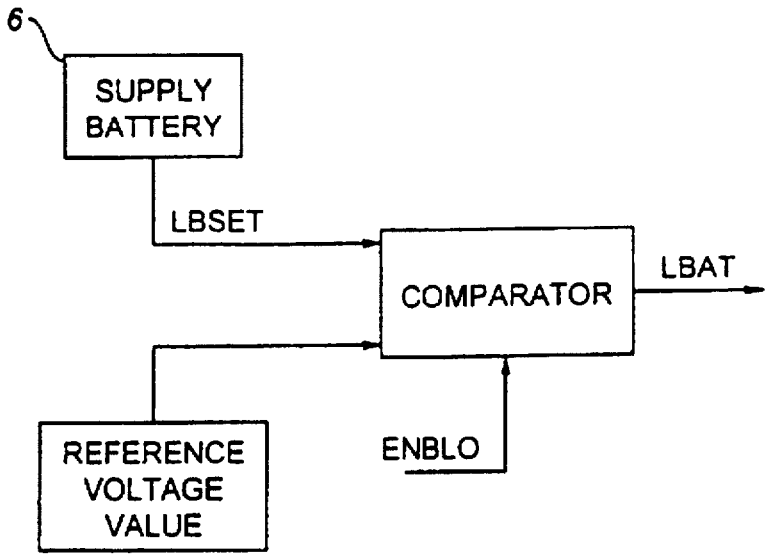
FIG. 6 is a block diagram of a main timer.
FIG. 7 is a block diagram of an interval timer.
FIG. 8 is a block diagram of a packet counter.
FIG. 9 is a block diagram of transmitter logic.
FIG. 10 is a block diagram of a battery tester.
Figure 6A:
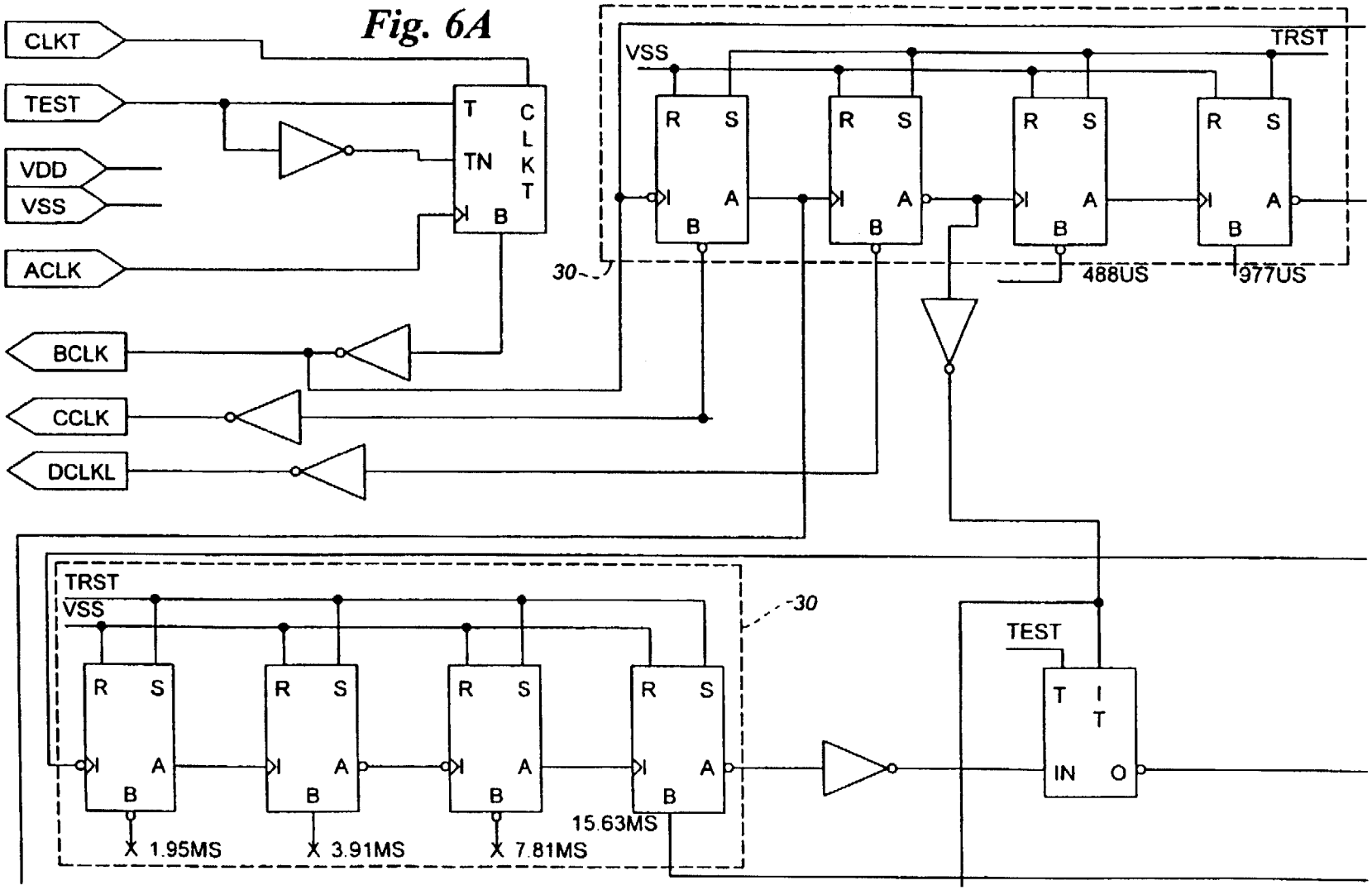
Figure 6B:
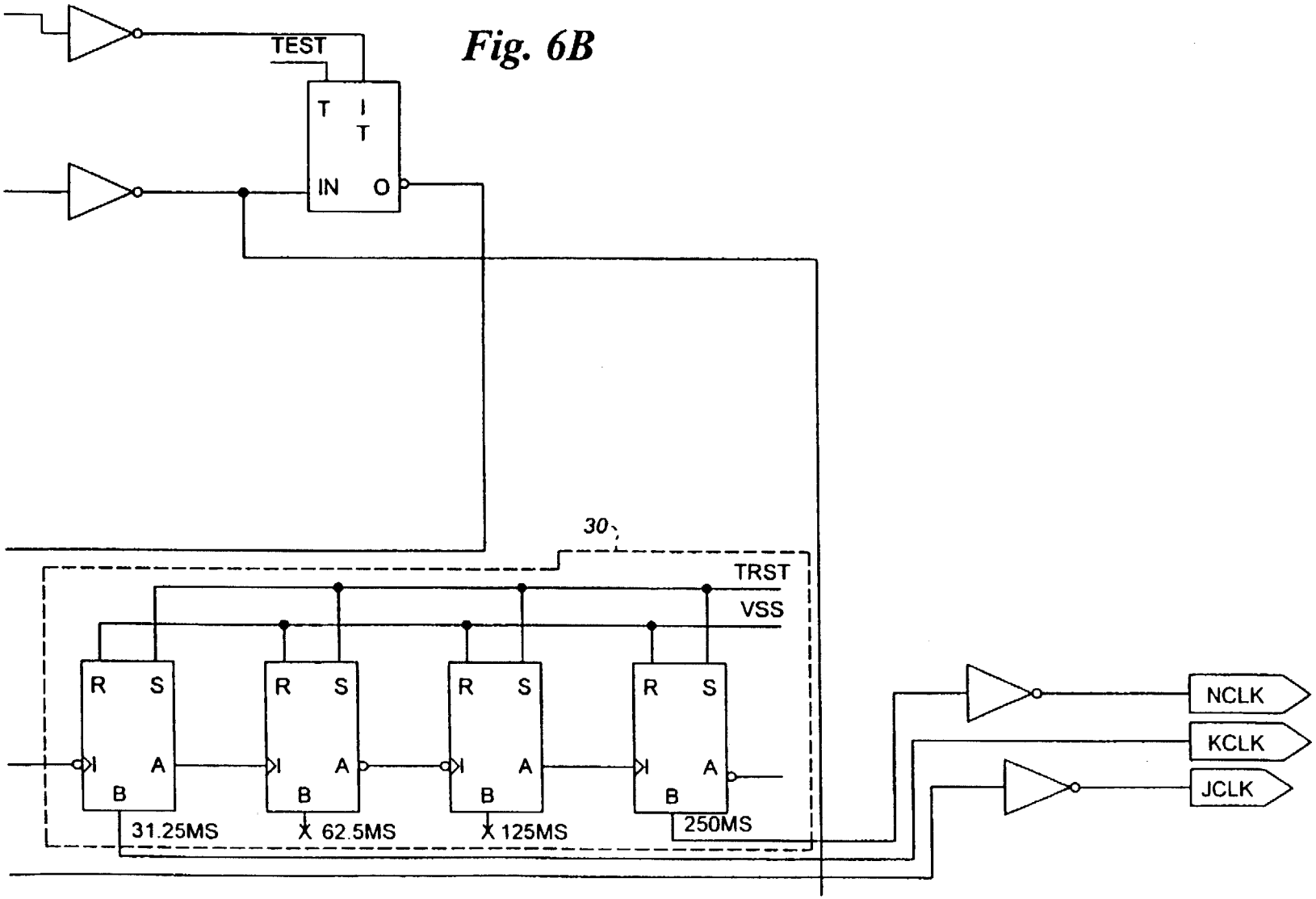
Figure 6C:
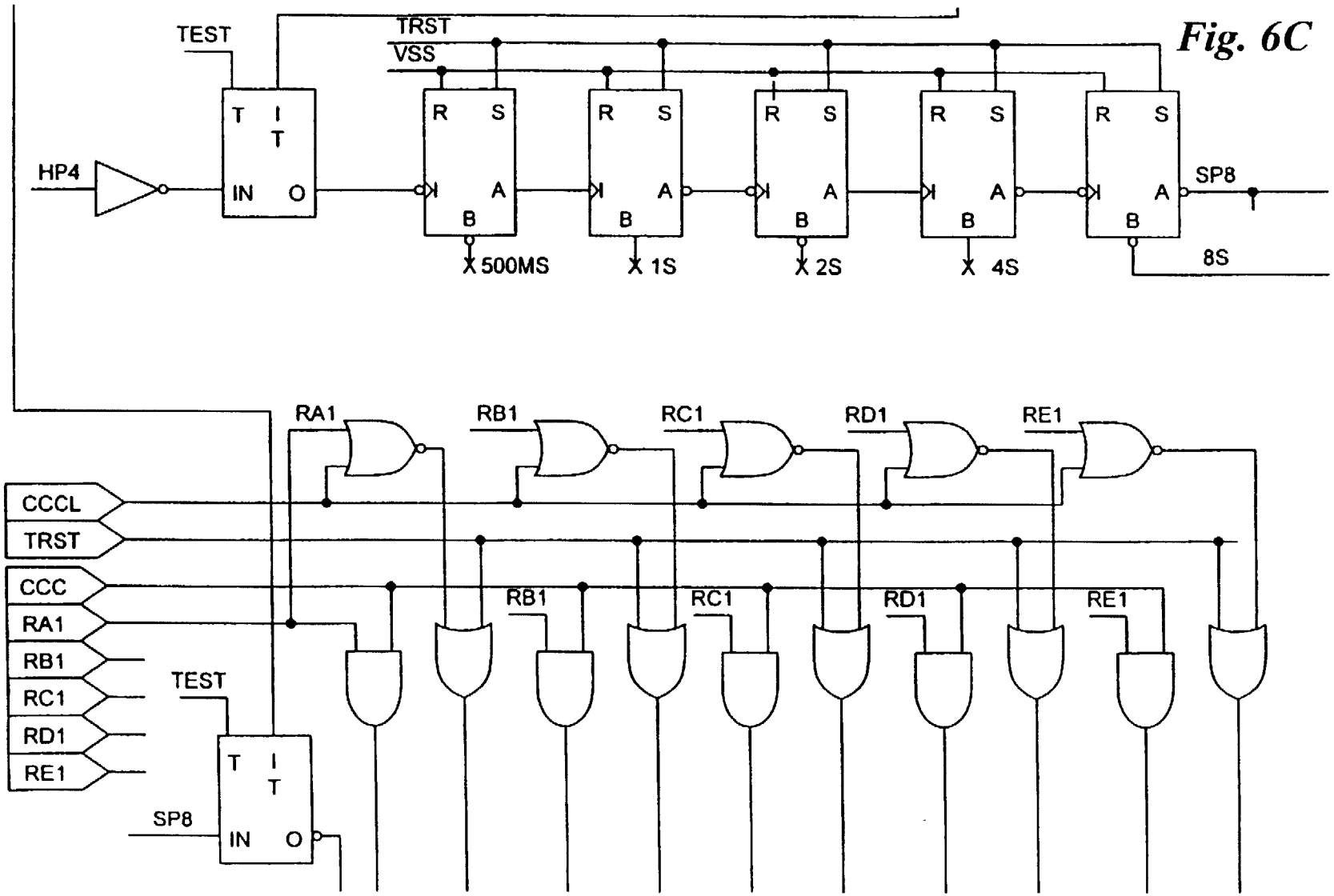
Figure 6D:
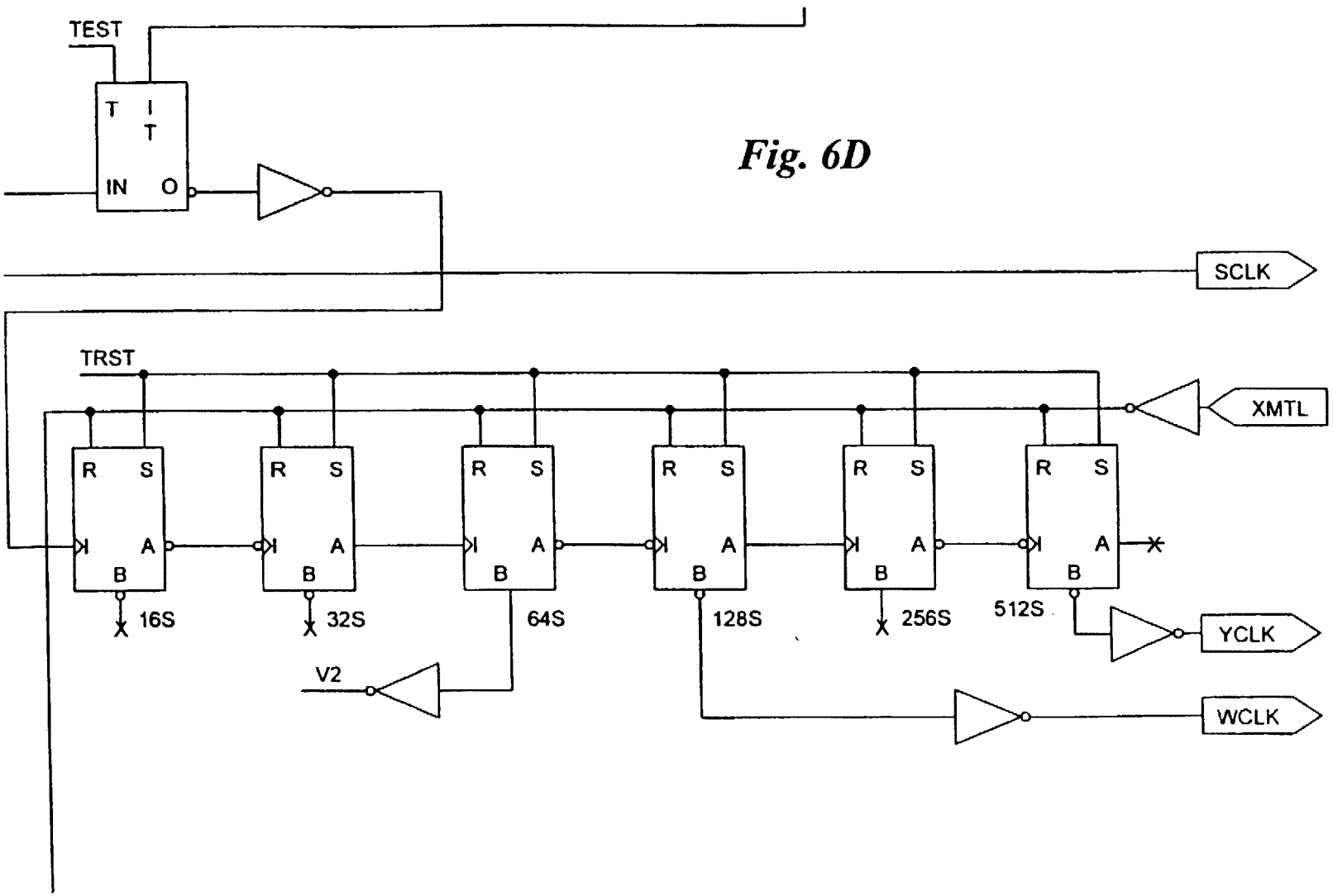
Figure 6E:
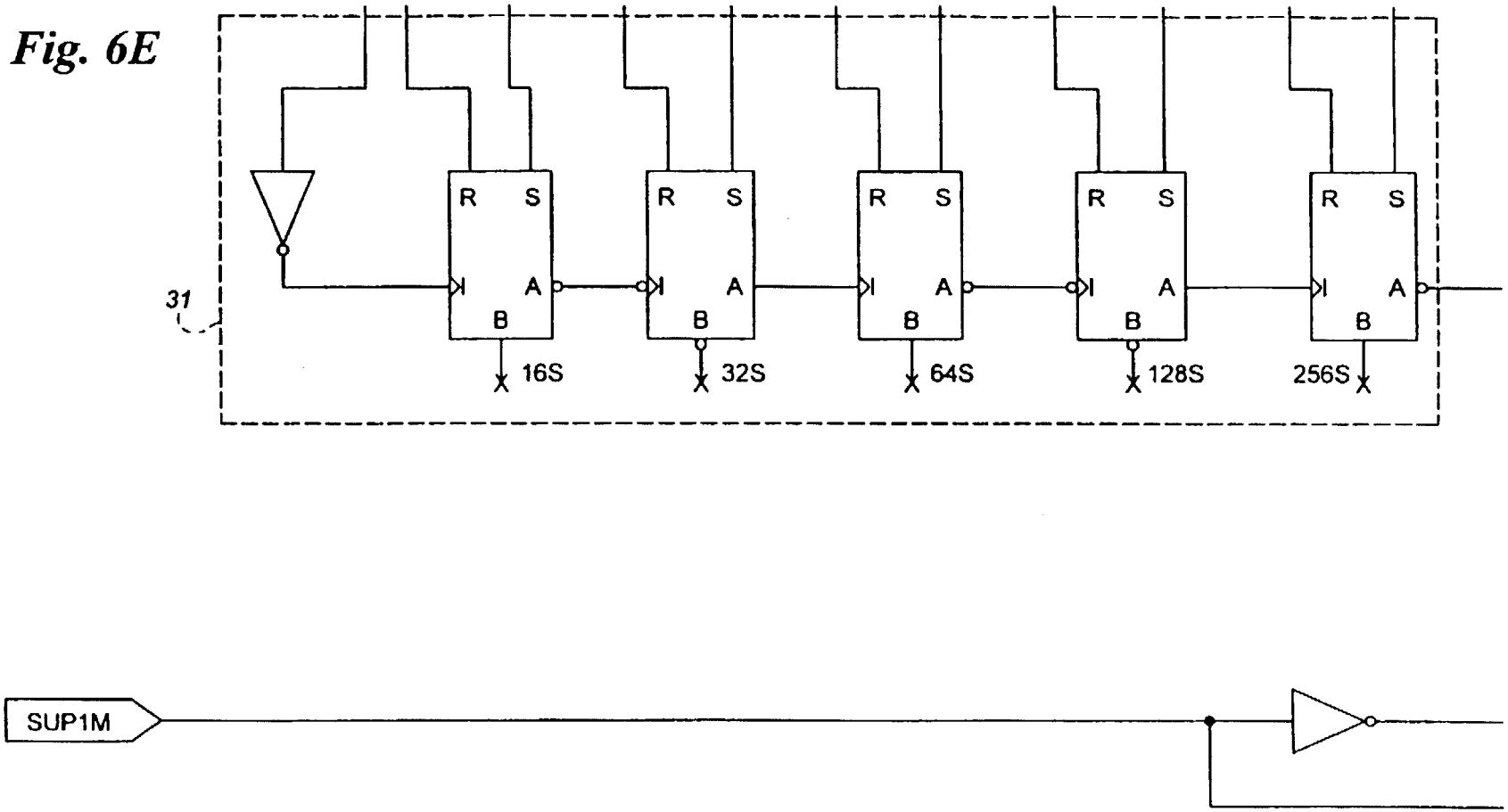
Figure 6F:
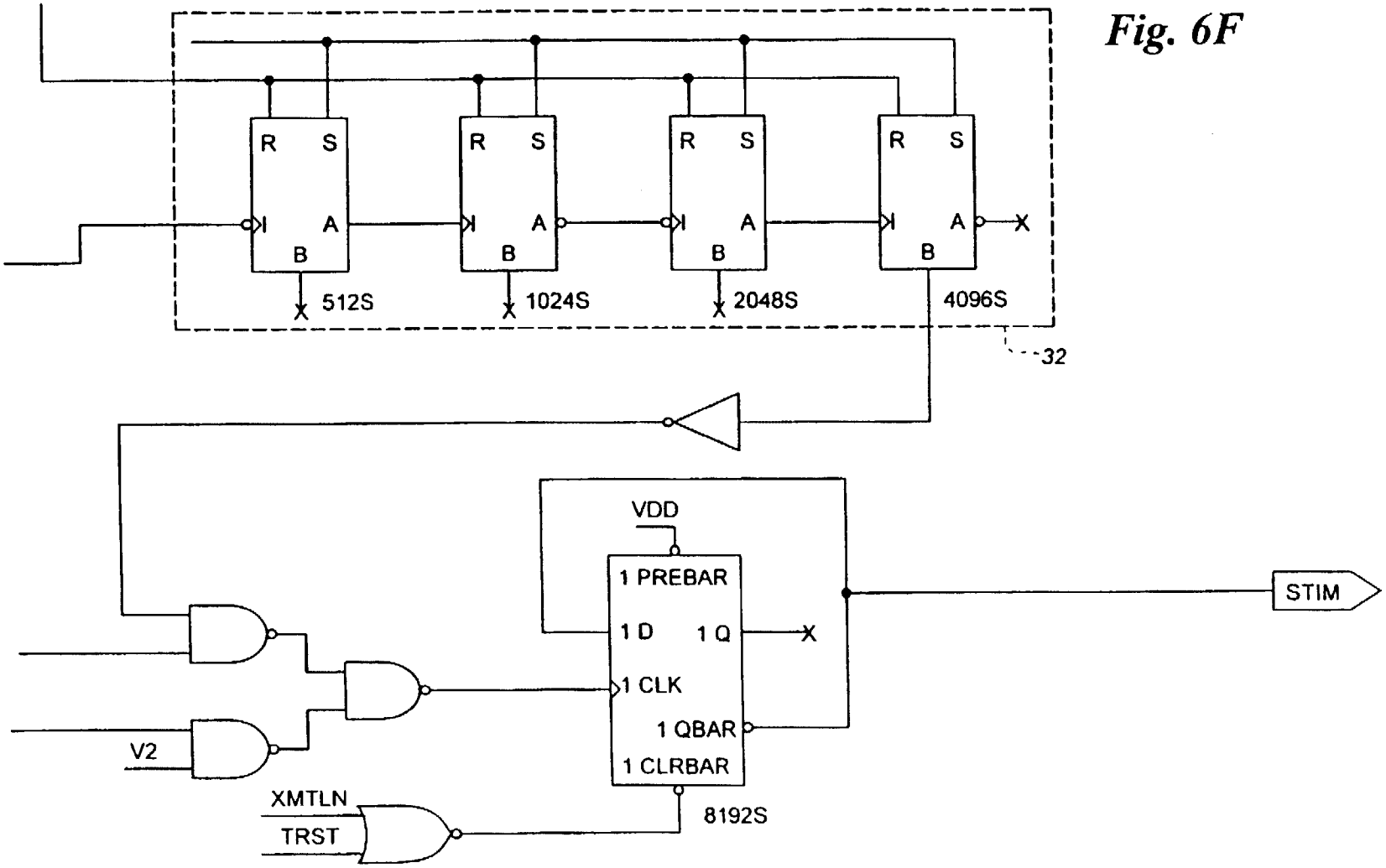
Figure 7A:
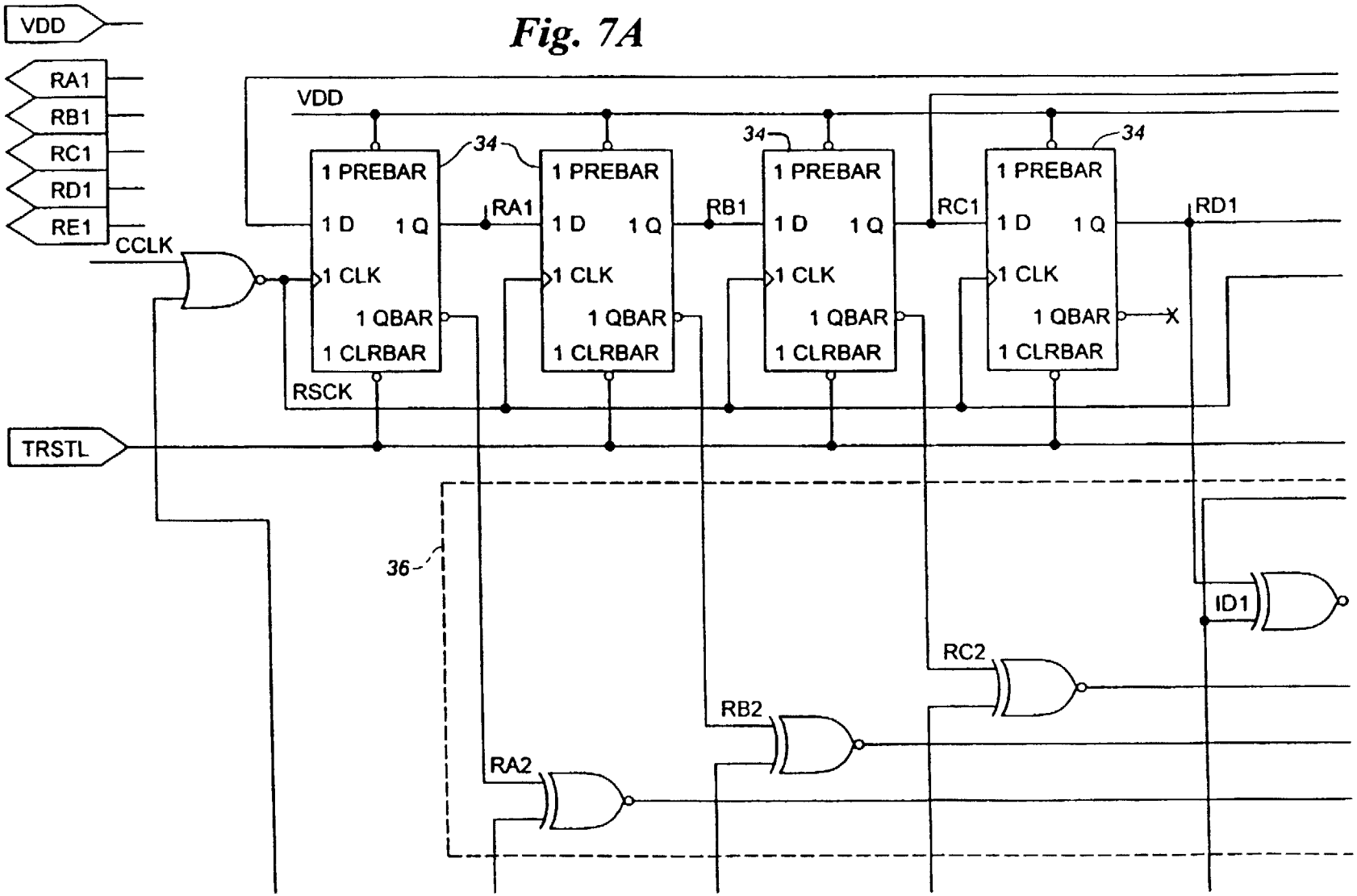
Figure 7B:
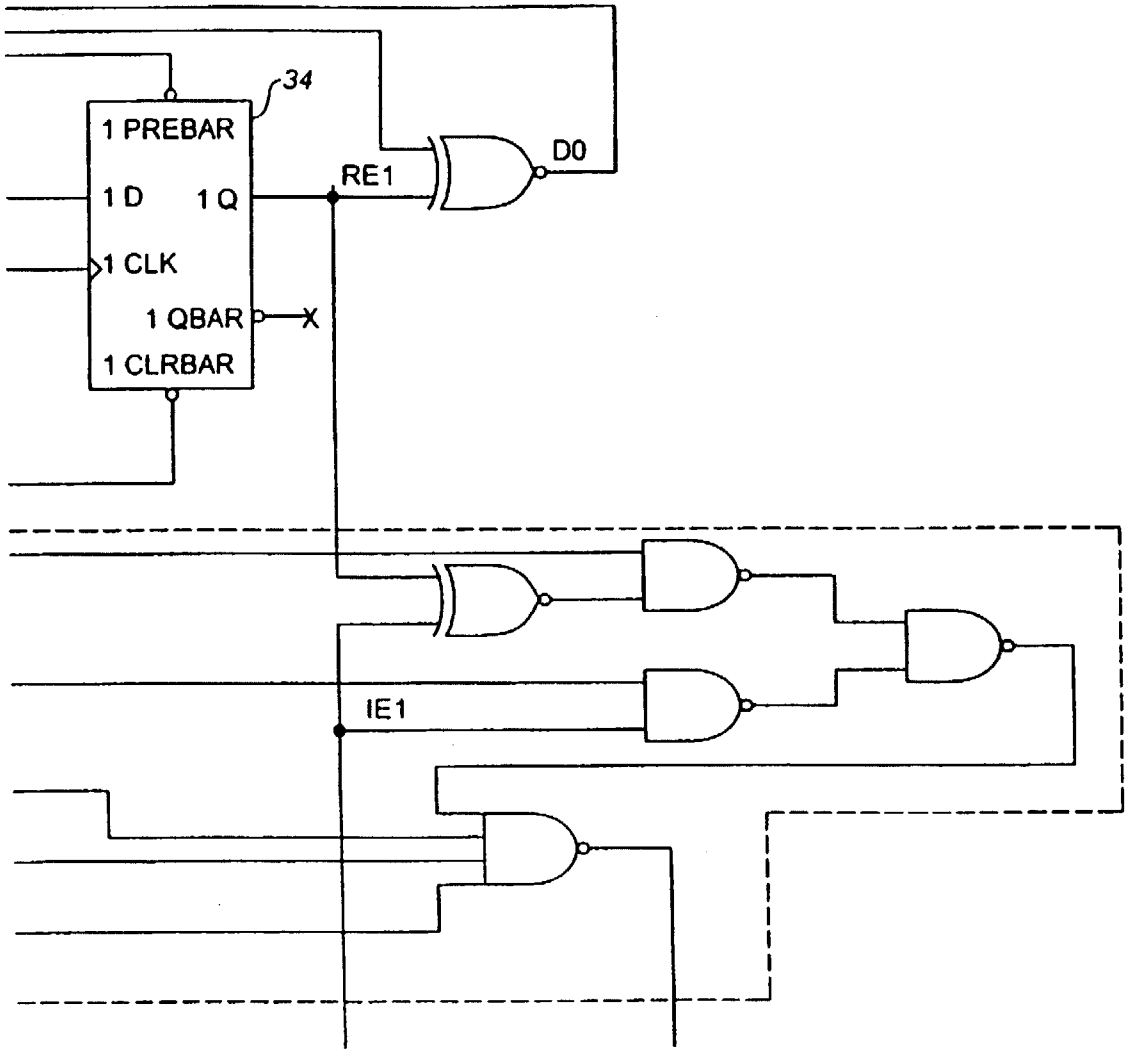
Figure 7C:
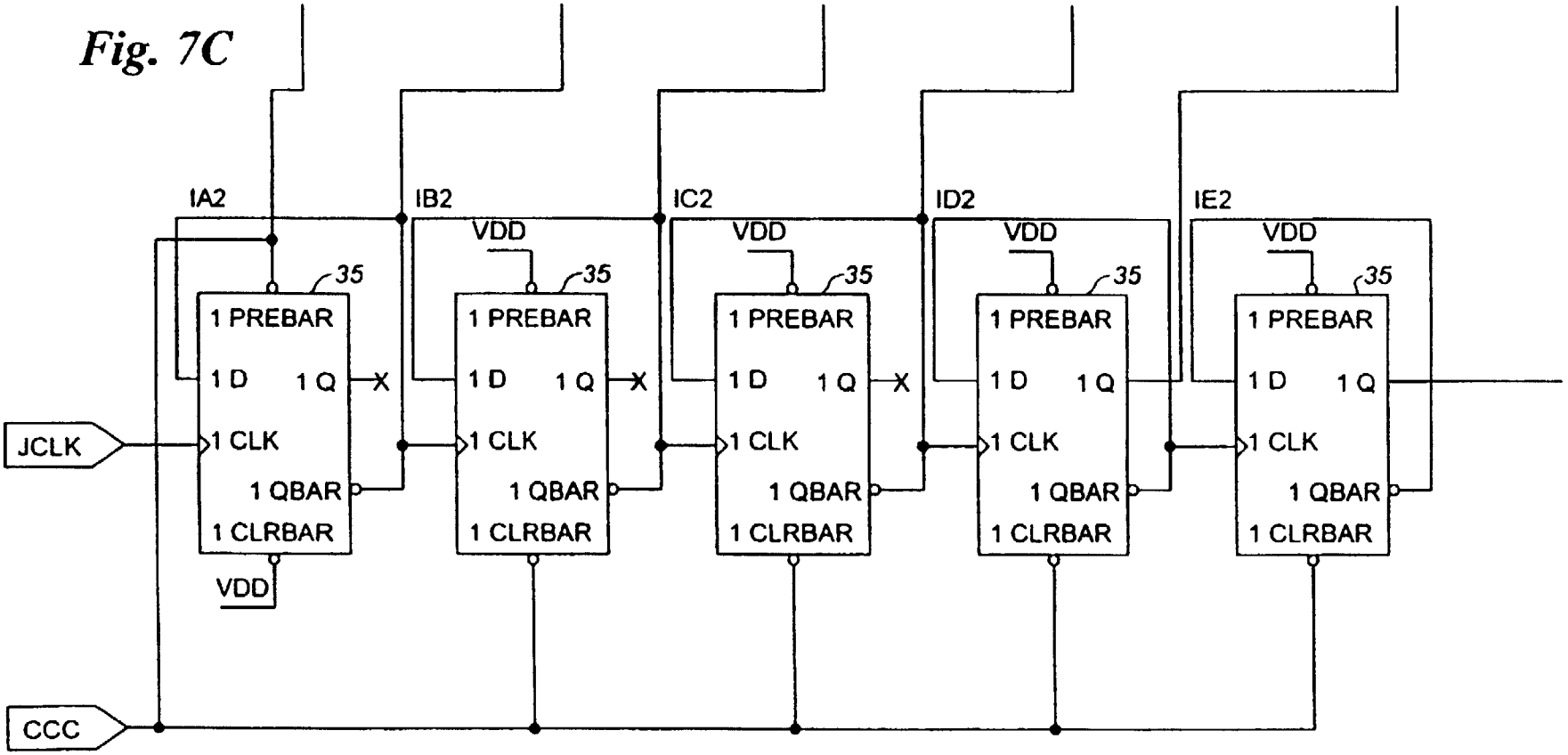
Figure 7D:
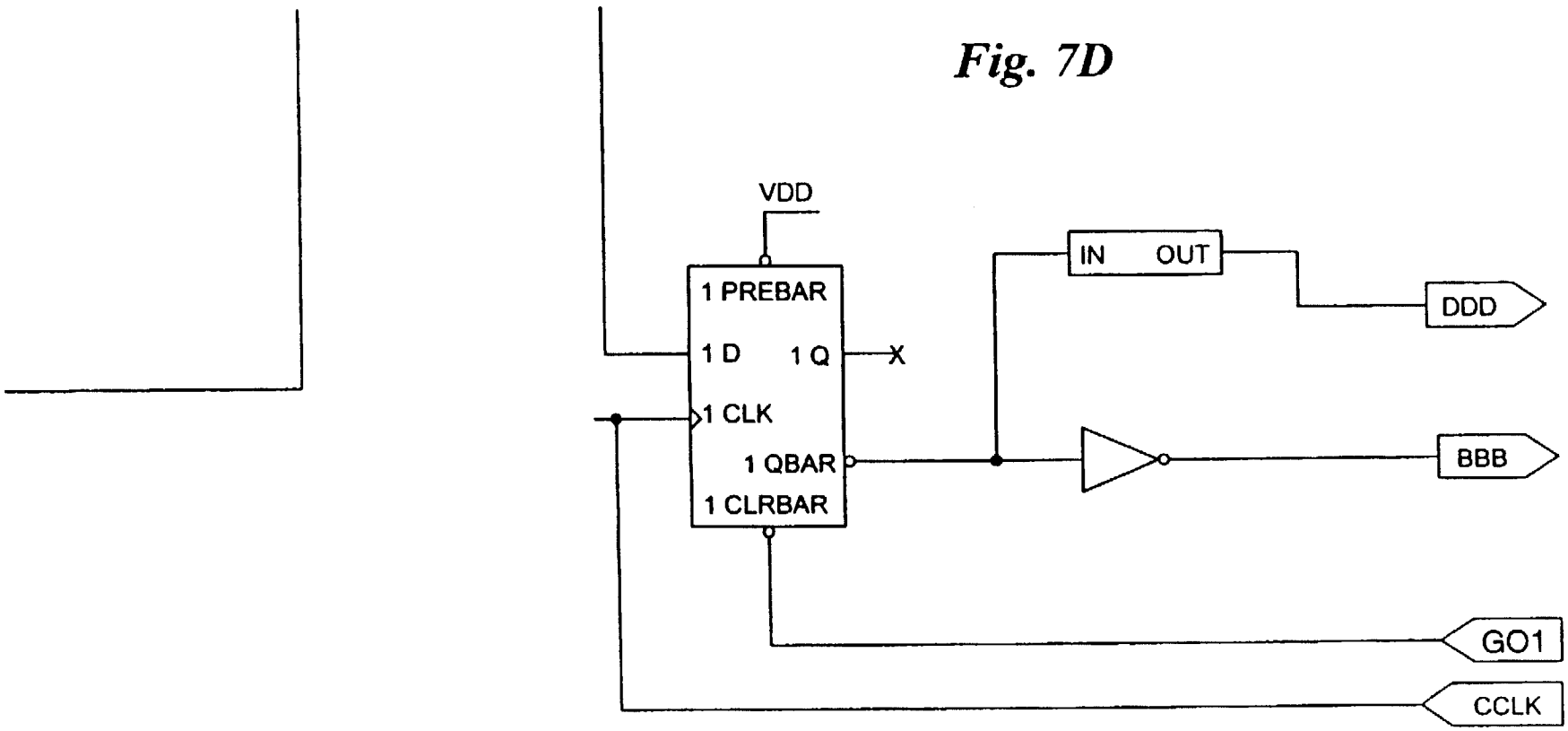
Figure 8A:
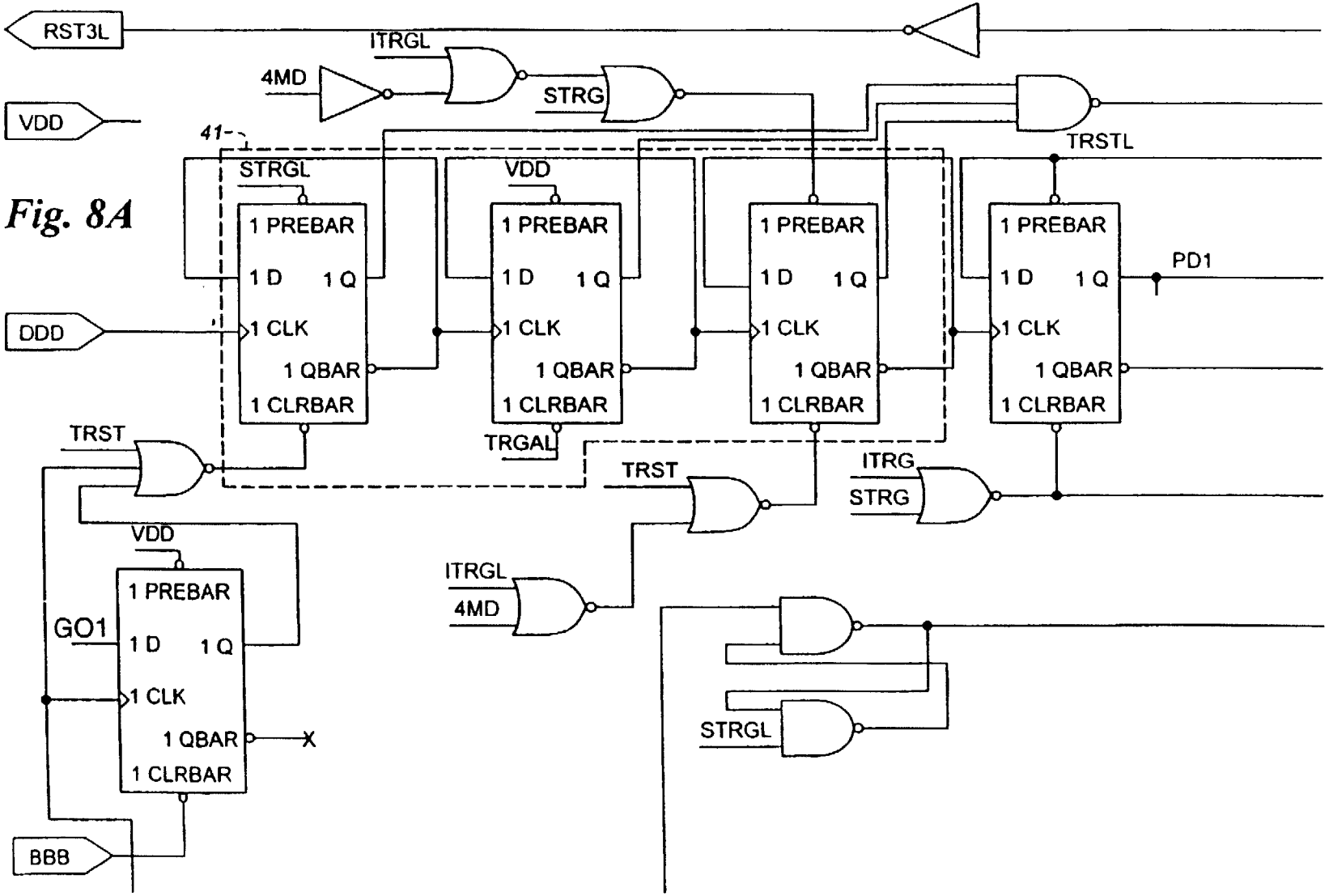
Figure 8B:
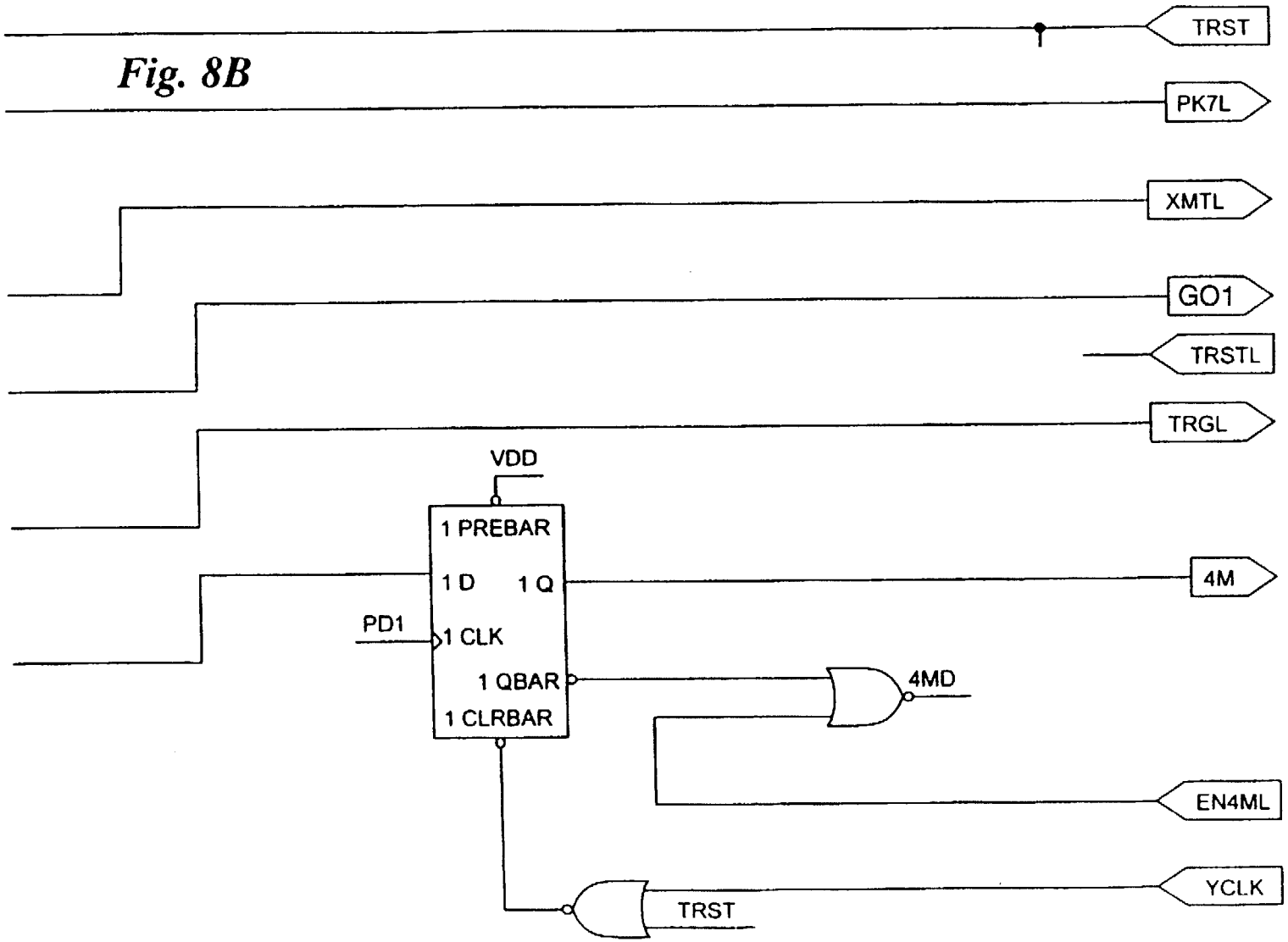
Figure 8C:
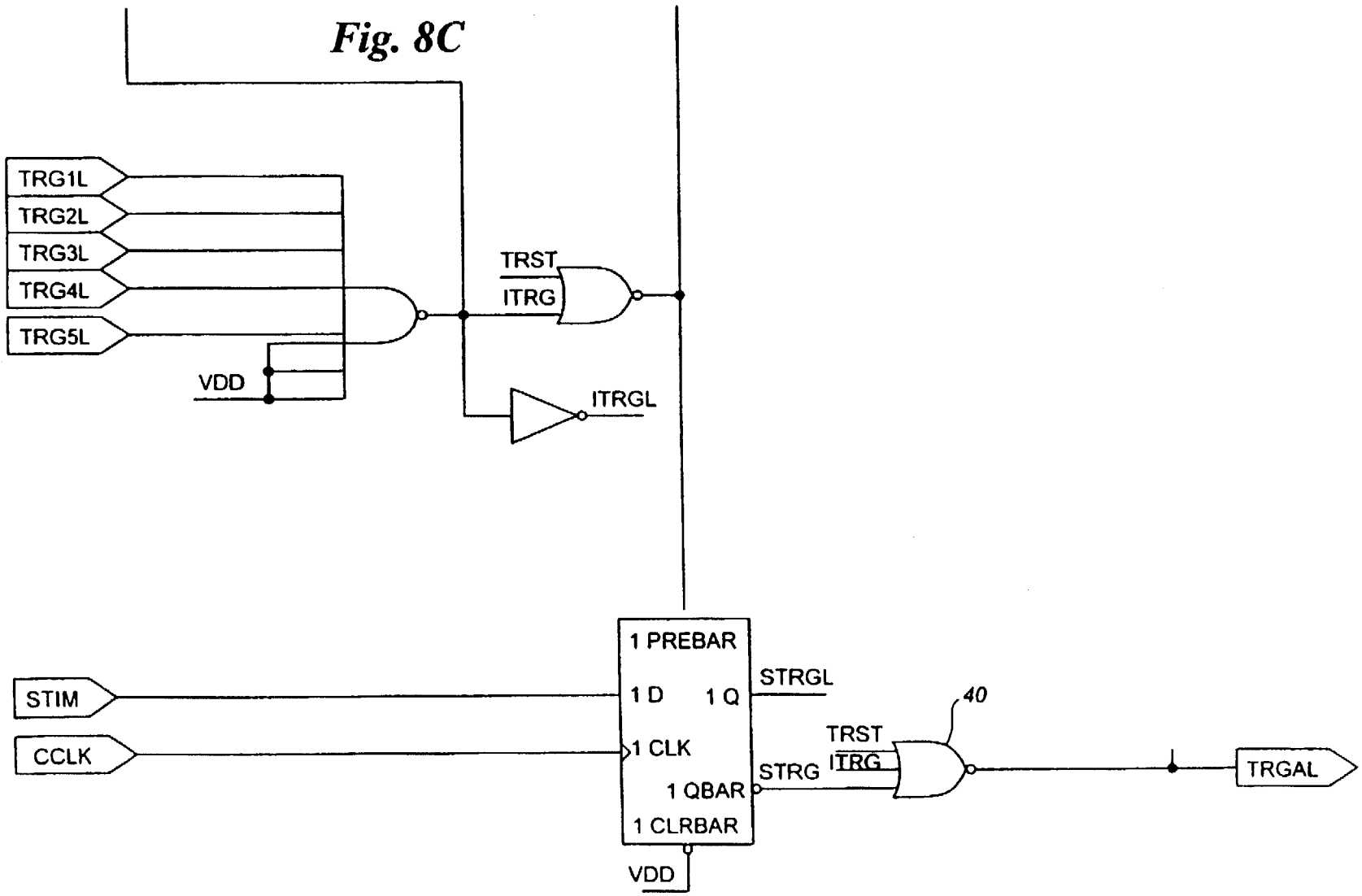
Figure 9A:
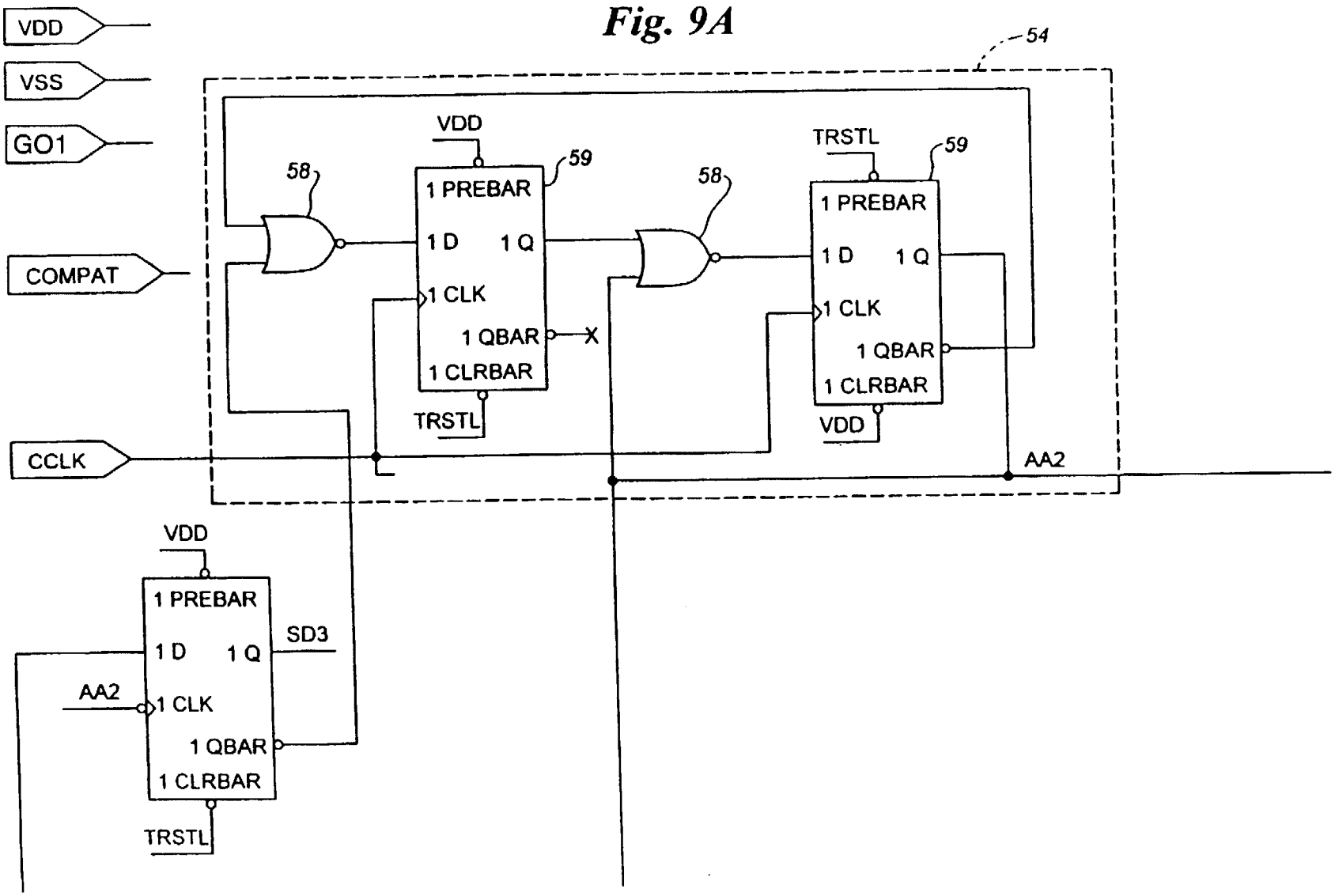
Figure 9B:
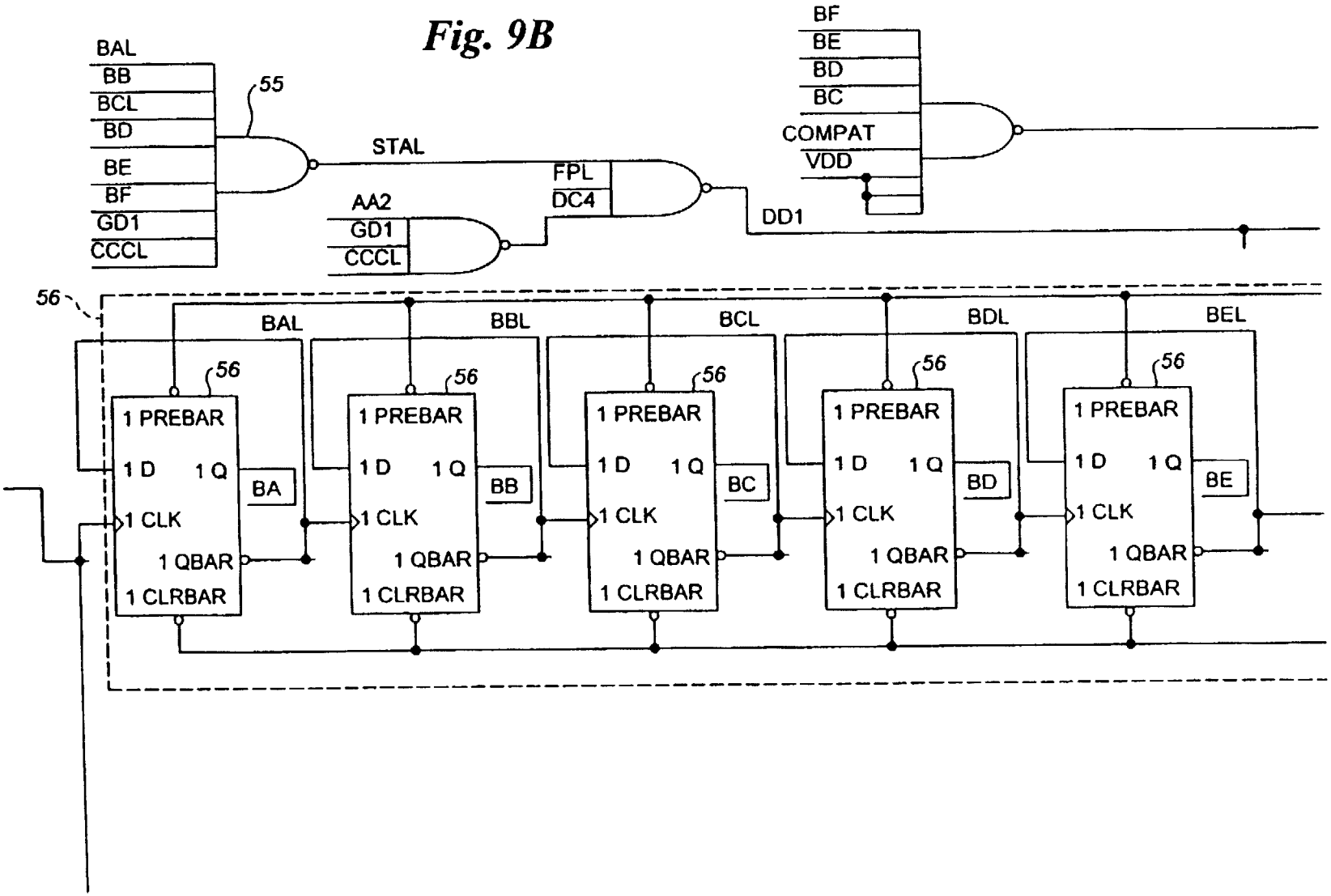
Figure 9C:
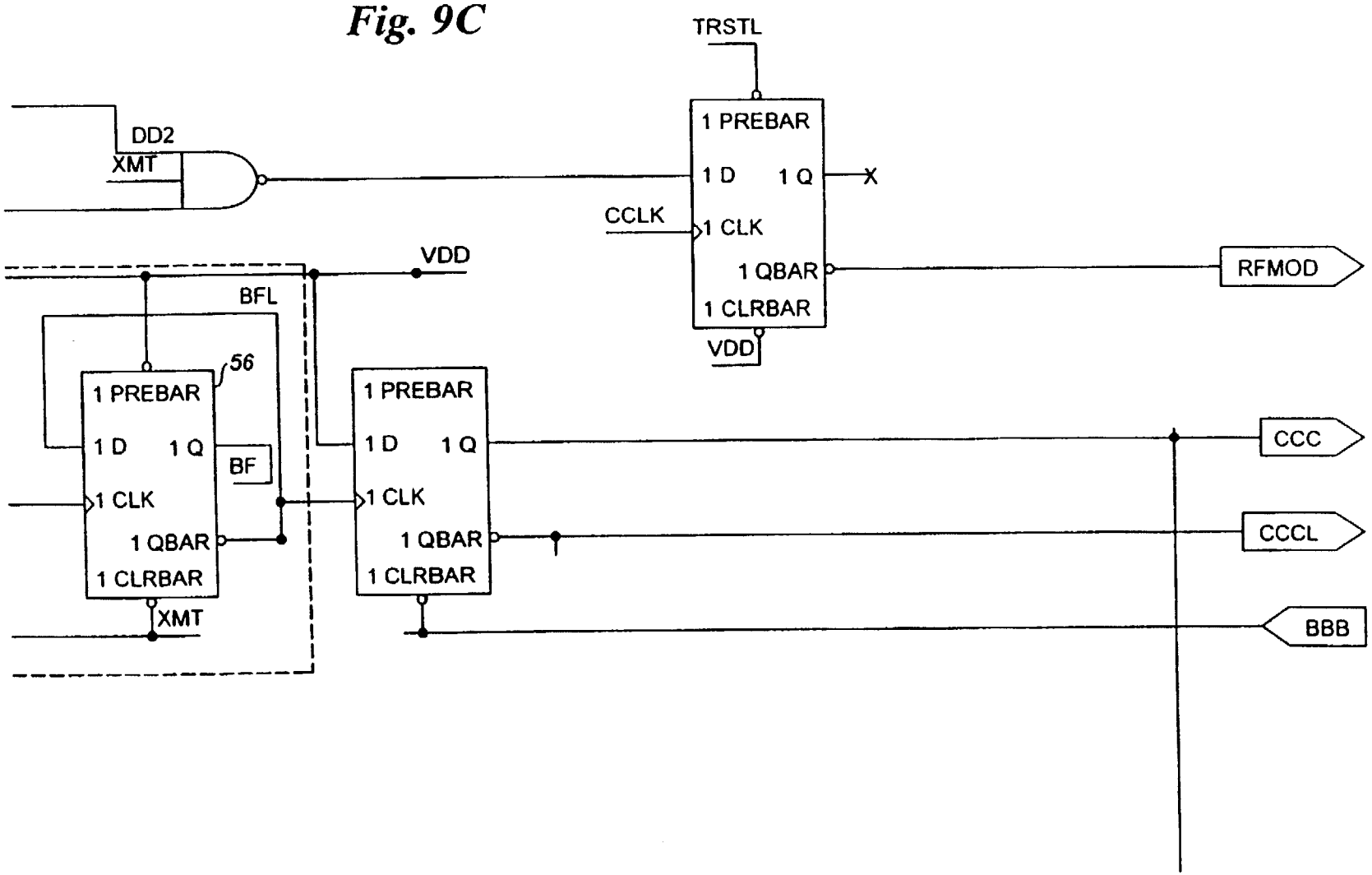
Figure 9D:
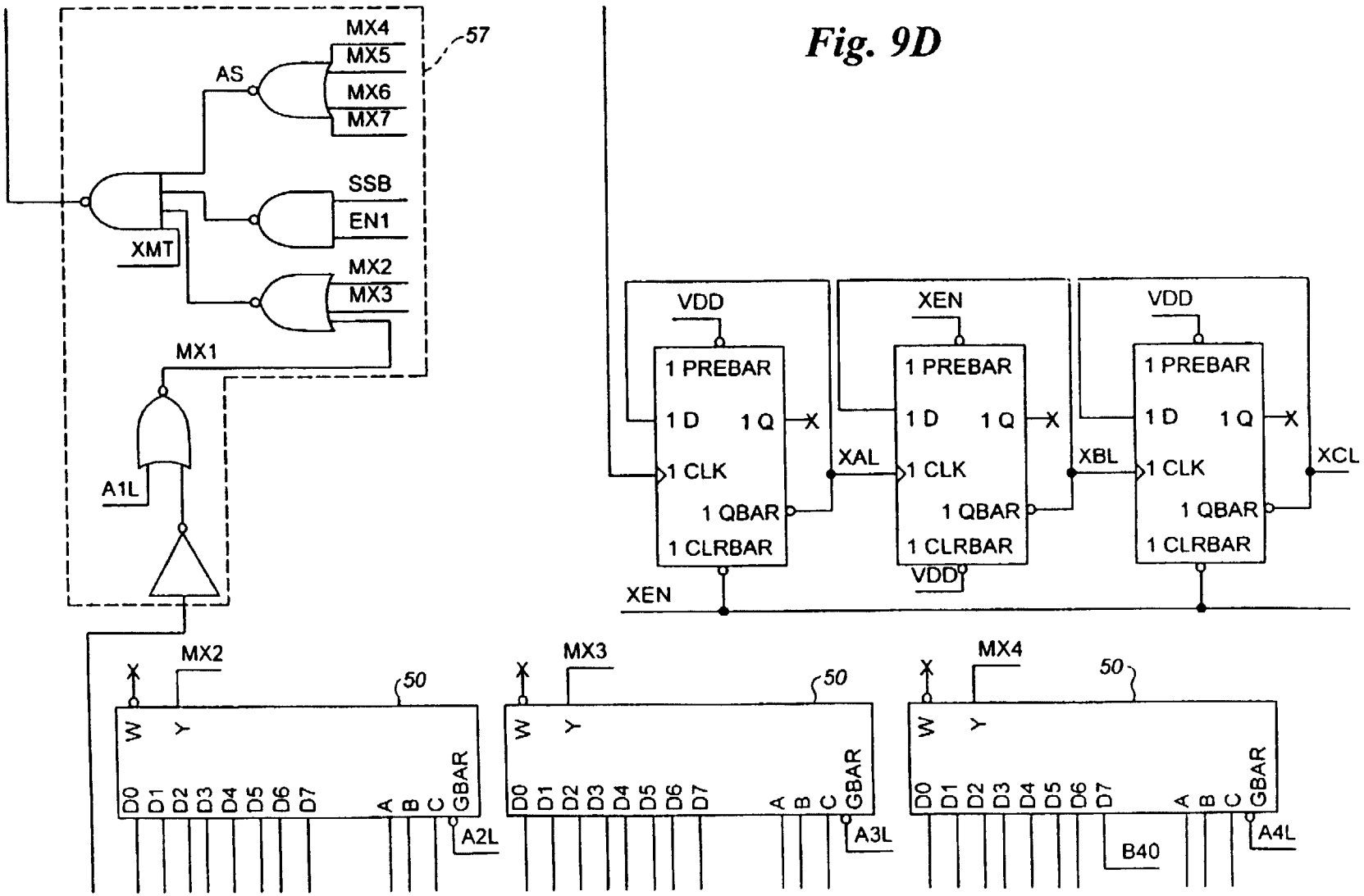
Figure 9E:
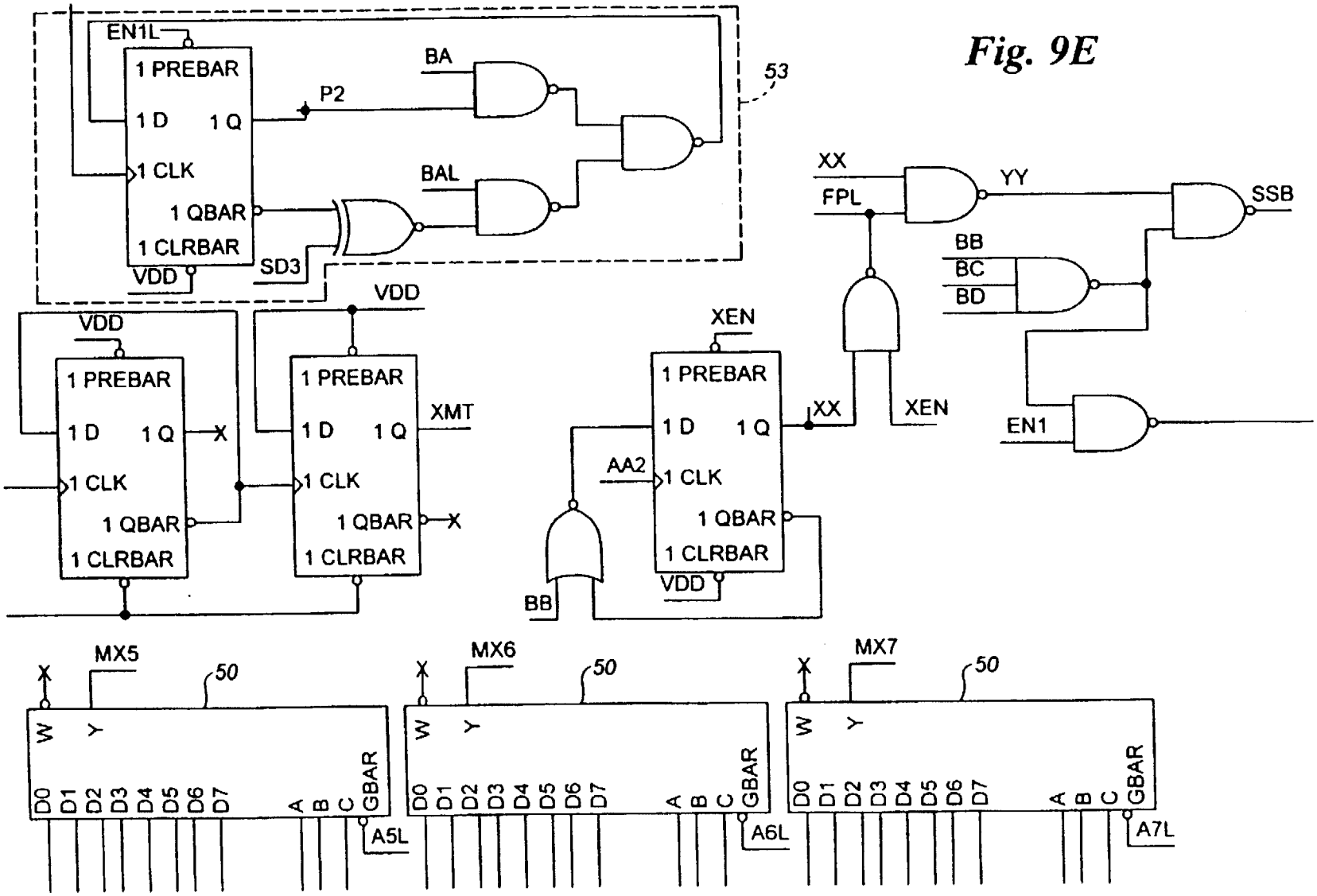
Figure 9F:
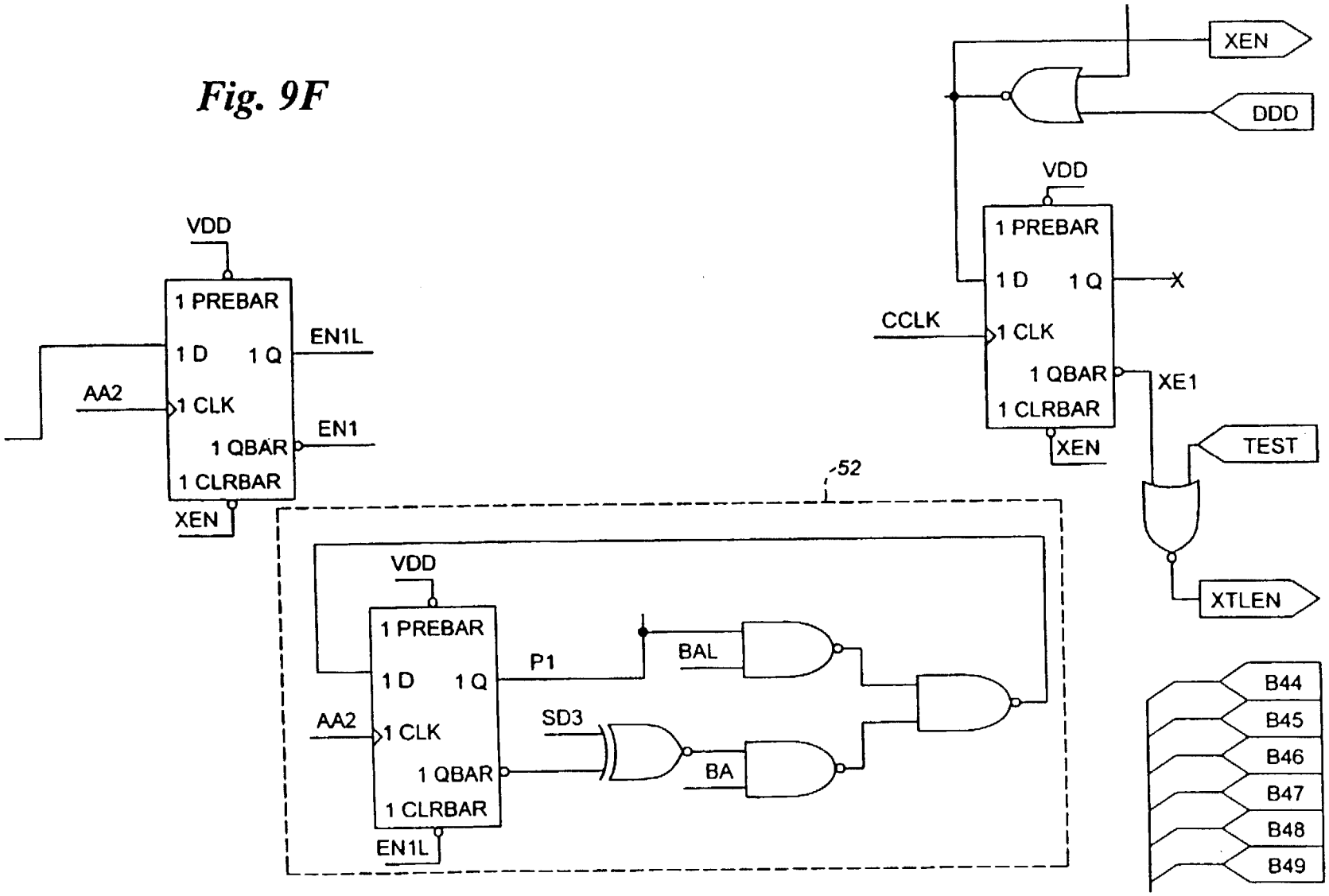
Figure 9G:
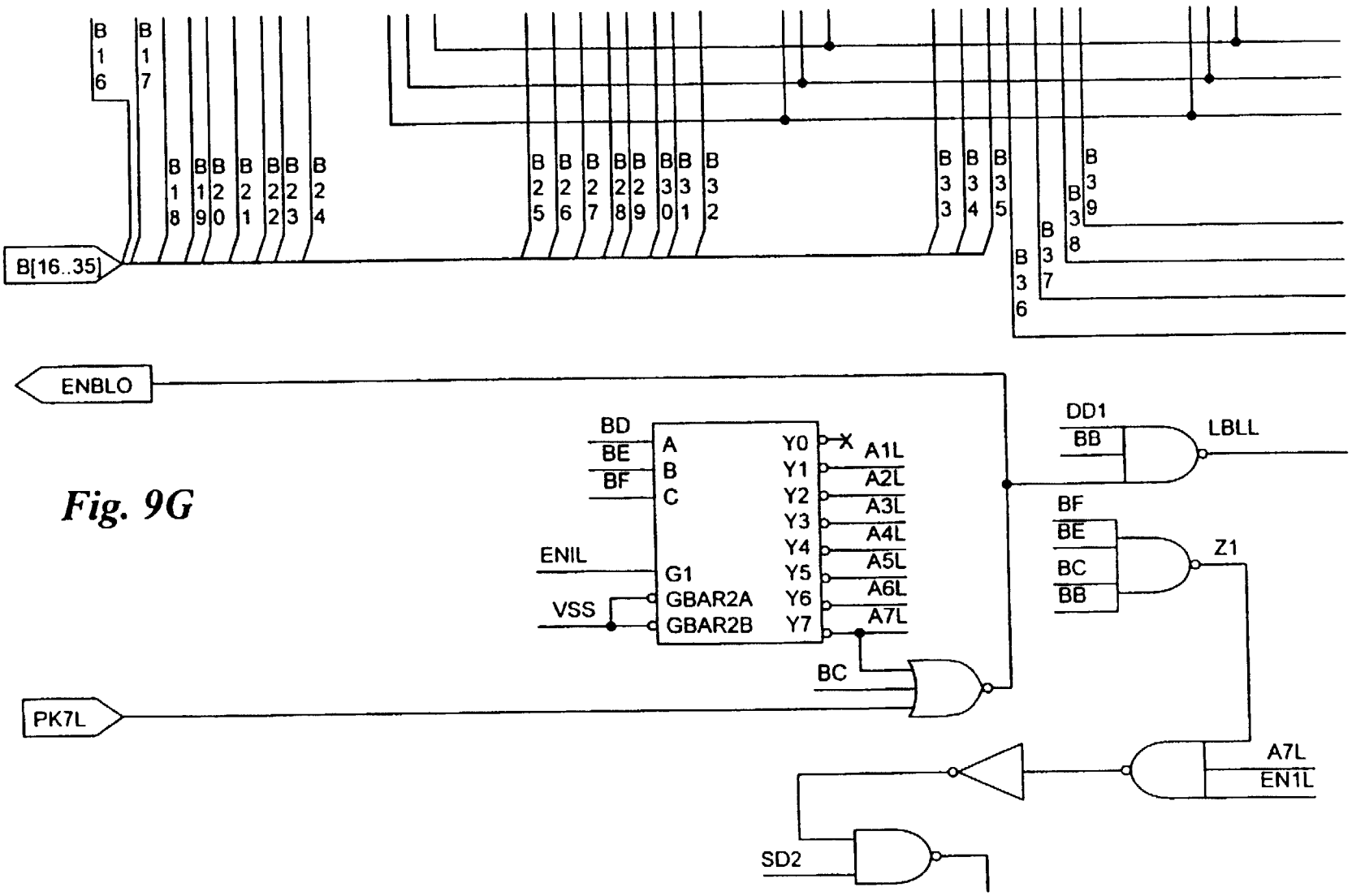
Figure 9H:
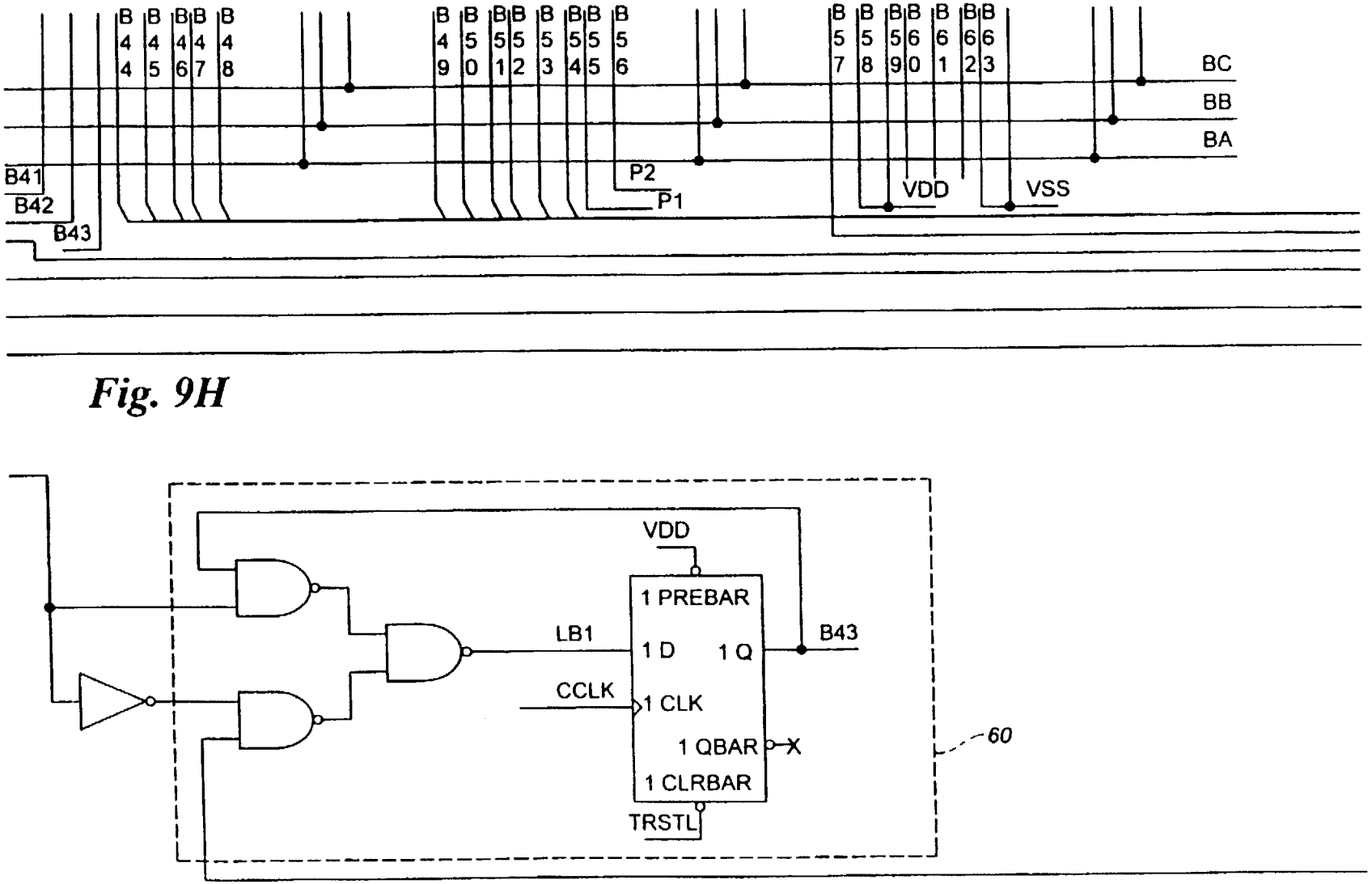
Figure 9I:
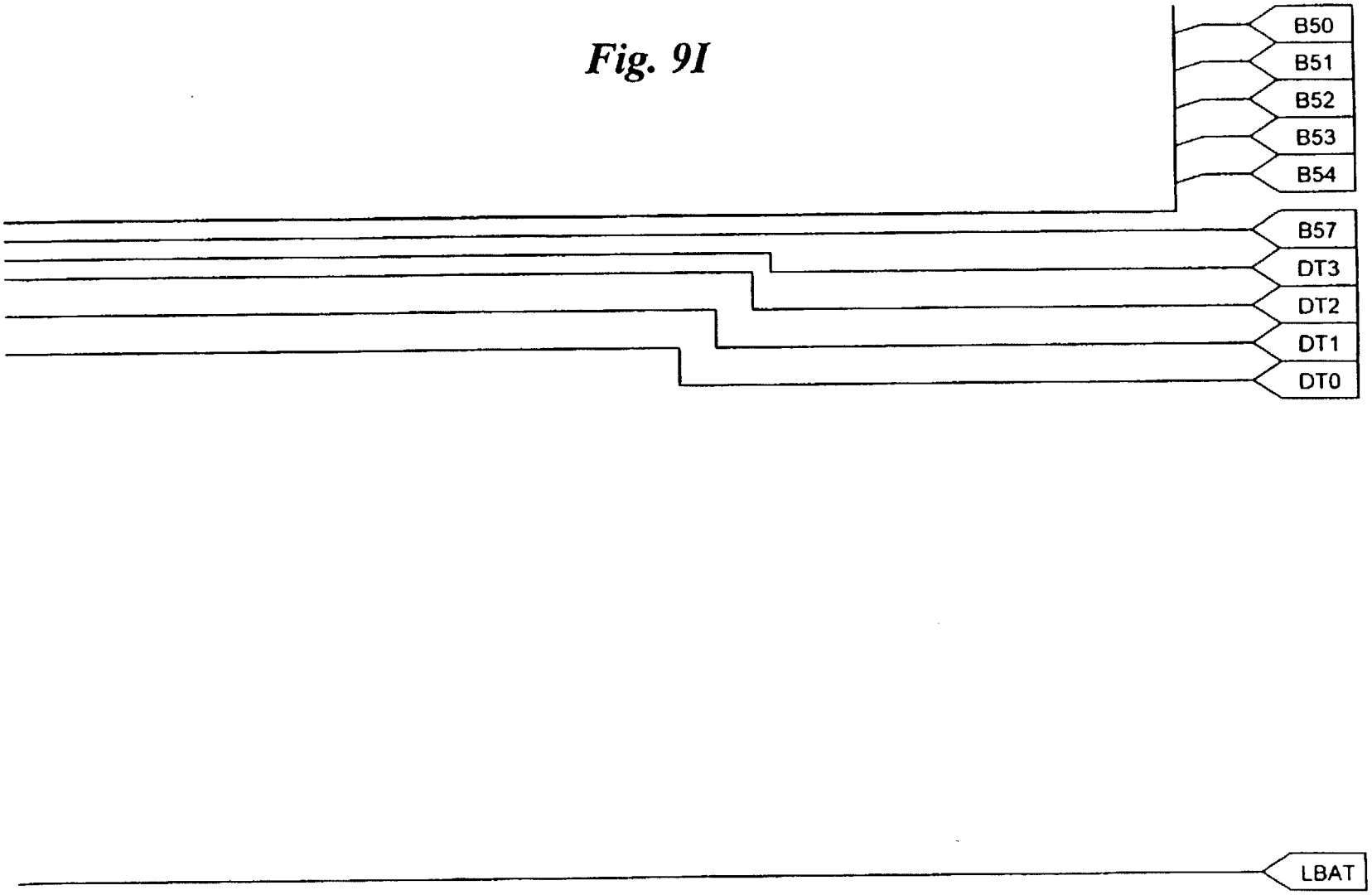
Figure 9J:
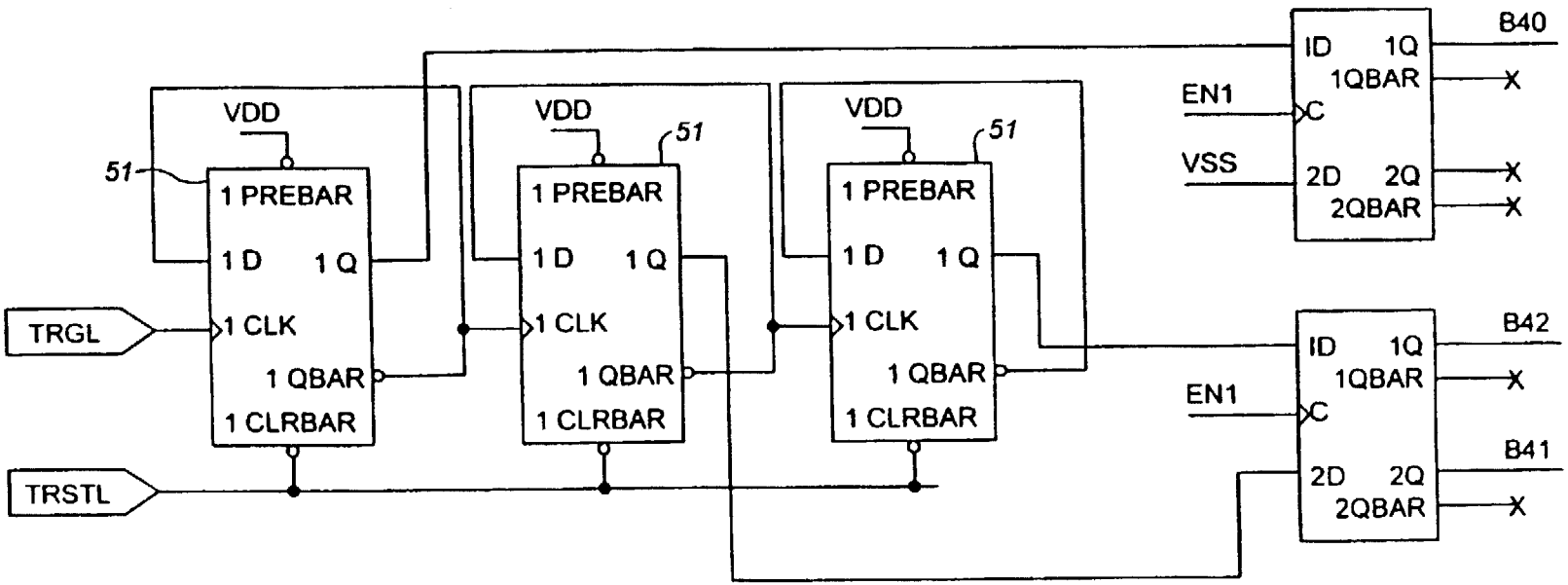
Figure 9K:
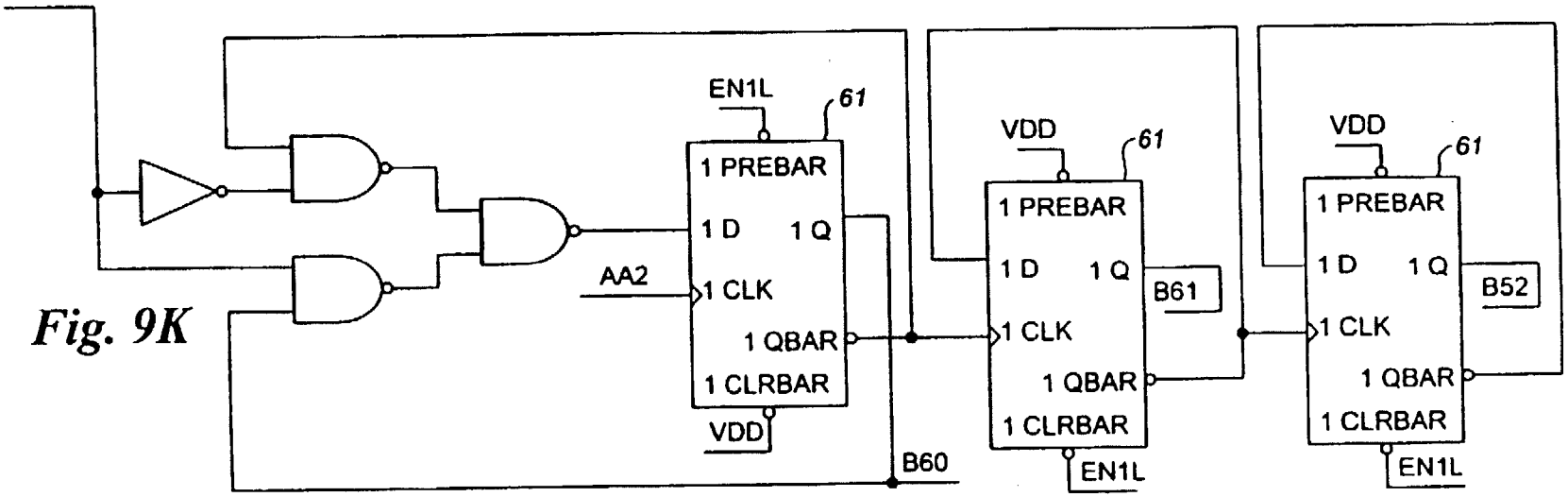
Figure 11:
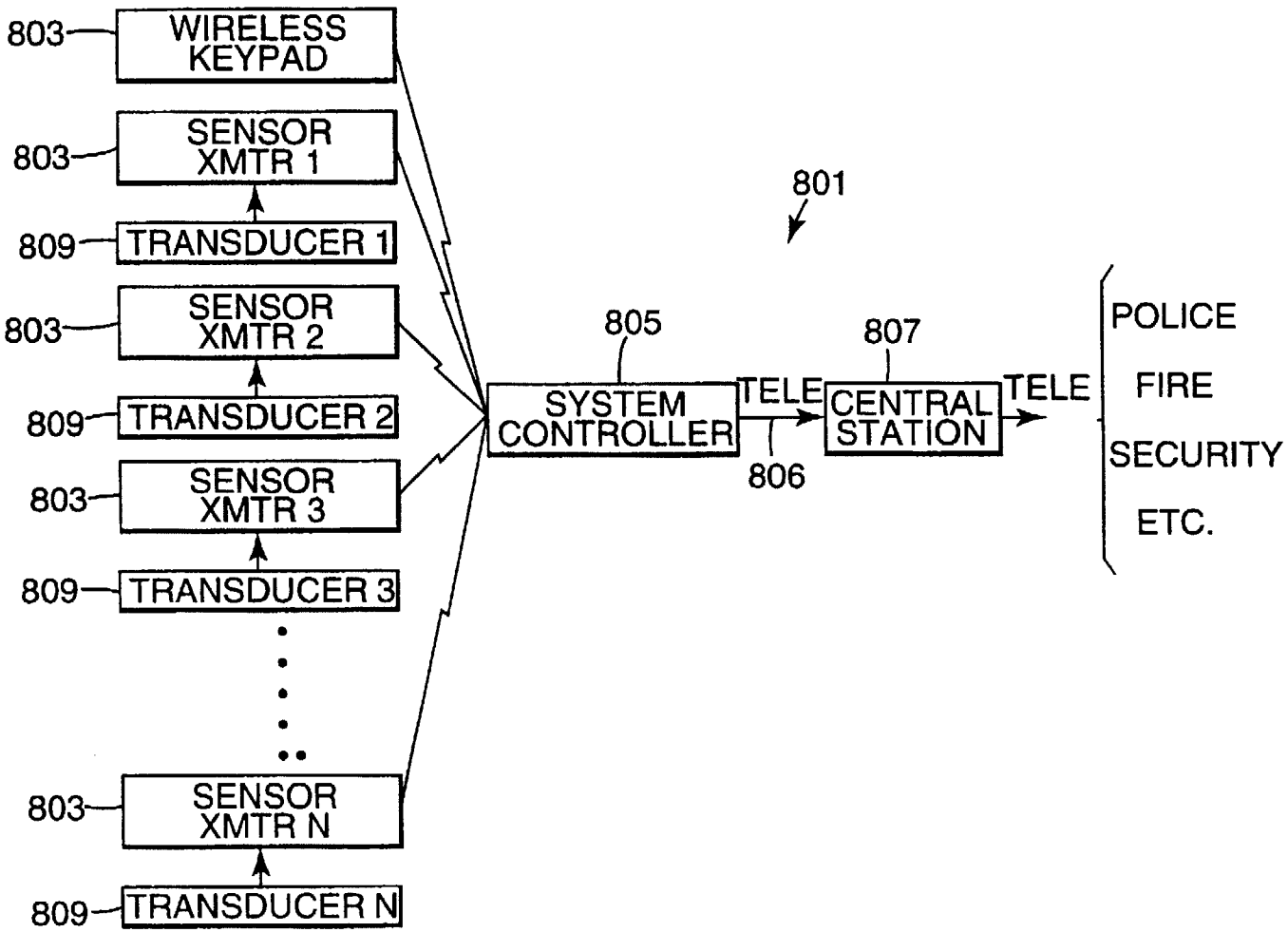
FIG. 11 is a block diagram of a message packet transmission system.

Turning to the main timer 13, as shown in FIG. 6, 32 kHz ticks are received from oscillator 134 as input ACLK. The 32 kHz signal ripples through flip-flops 30 to generate BCLK (61 μs), CCLK (122 μs), DCLK (244 μs), NCLK (250 ms), KCLK (31.25 ms), JCLK (15.63 ms), SCLK (8 seconds), YCLK (512 seconds), and WCLK (128 seconds). Other clock signals are also generated, including 62.5 ms and 125 ms.

The lower half of FIG. 6 discloses a timer used to generate the pseudo-random supervisory timing period between sixty-four (64) and sixty-eight (68) minutes from the end of the last packet transmission. The pseudo-random period is used to prevent packet collisions at the system controller. To achieve the pseudo-random interval, interval timer 14 generates a five-bit pseudo-random number on lines RA1 through RE1 (FIG. 7). This number is sent to a two hundred and fifty-six second timer, formed by flip-flops 31, generating a period from zero to two hundred and fifty-six seconds (roughly zero to four minutes). This number is then added into flip-flops 32, to generate a pseudo-random period from 64 to 68 minutes.

Input signal XMTL resets the supervisory timer after every message packet generated by transmitter 1. When input signal SUPIM, from EEPROM 17, is a logical 1, the supervisory time period is reduced to sixty-four (64) seconds (e.g., for high security applications).

Interval timer 14 generates a pseudo-random time interval (from approximately 93 to 453 ms) between packets within a group, reducing the possibility that collisions of critical packets will occur at the system controller.

As shown in FIG. 7, flip-flops 34 function as a pseudo-random sequence generator having the sequence: 15, 08, 17, 1E, 1D, 1B, 16, 0D, 1A, 14, 09, 13, 06, 0C, 18, 10, 00, 01, 03, 07, 0E, 1C, 19, 12, 04, 08, 11, 02, 05, 0A 15

This pseudo-random sequence generator is driven by timing signal CCLK from main timer 13.

The lower half of FIG. 7 discloses a counter formed by flip-flops 35 using JCLK from main timer 13 and signal CCC from transmitter logic 12. The counter is reset at the end of each packet transmission by signal CCC. The pseudo-random sequence generator is then stopped at a pseudo-random value. Gate array 36 allows the lower counter to count until the following equivalencies are met: IA1=RA1 and IB1=RB1 and IC1=RC1 and [(ID1=RD1 and IE1=1) or (IE1=RE1 and ID1=1)]. This yields a pseudo-random time interval between 93 and 453 ms. Interval timer 14 then generates end-of-interval pulses DDD and BBB, which are sent to packet counter 15 and transmitter logic 12.

Packet counter 15 works with transmitter logic 12 and interval timer 14 to determine the correct number of packets for transmission and then count the generated packets. As shown in FIG. 8, packet counter 15 has five types of inputs. Signals DDD and BBB are generated by interval timer 14 at the end of each pseudo-random time interval between packets. Signals TRG1L to TRG5L are inputs from each of the input processors 10. Signal STIM is from main timer 13 and generates a signal pulse when the supervisory time interval times out. Signal EN4ML is from EEPROM bit EP28 and enables the battery saving feature where new sensor inputs detected within 4.25 minutes of the end of the last packet transmission yield a message transmission of only four packets. Finally, packet counter 15 includes various clock inputs, including signals CCLK and YCLK.

Flip-flops 41 are used to count the number of packets for each transmission. As discussed above, normally the transmitter generates a group of eight identical message packets for each sensor input detected. In order to save the transmitter battery, the transmitter can be programmed at EEPROM bit EP28 to generate only four message packets if a change in sensor input is detected within 4.25 minutes of the end of the last packet transmission. Finally, when the supervisory period times out, only three message packets are generated for the supervisory message.

Under normal operating conditions, any one of the TRG1L to TRG5L input signals will cause flip-flops 41 to count eight packets before generating signal PK7L (discussed further below). If EEPROM bit EP28 is set to a logic 1, then the four packet feature is enabled. Therefore, if a sensor input is generated by one of TRG1L to TRG5L within 4.25 minutes of the end of the last packet transmission, flip-flops 41 will generate the signal PK7L after four packets are counted.

If there are no changes in inputs detected within the supervisory time interval, signal STIM causes flip-flops 41 to count three packets before generating signal PK7L.

Signal PK7L is sent to transmitter logic 12 and is used to latch the low battery signal (LBAT) on the stop bit of the last packet for that transmission. As discussed above, the last packet may be either the eighth, fourth, or third packet.

Packet counter 14 also generates the output signal 4M, which is used to control switching of the strong or weak pull-up resistors as discussed above regarding FIG. 4A. Signal TRGAL is sent to the EEPROM circuitry to load the EEPROM data into associated EEPROM latches. This configuration helps ensure that the correct EEPROM data is used for each set of message packets. The TRGAL signal is generated on each sensor input that generates a TRG1L to TRG5L signal, or the supervisory times out and generates the STIM signal.

The XMTL signal is sent to main timer 13 and is used to reset the flip-flops used to count the supervisory time interval. Therefore, the supervisory time interval is always counted from the last packet transmission, whether that packet transmission is based on a detected change in sensor inputs or a previous supervisory message. Signal XMTL is also sent to each of the input processors 10 and resets the latched input signal, FXLTCH, at the end of each transmission.

Signal TRGL is sent to transmit logic 12 and used to generate a three-bit trigger count.

Transmitter logic 12 is connected to the other major components of transmitter 1 to generate the message packets. As shown in FIG. 9, multiplexers 50 have as inputs the data for each packet, i.e., bits 16–63, including the device ID code (bits 16–35), device type code (bits 36–39), a "trigger" count (bits 40–42) which counts the number of times the transmitter has been triggered (either sensor or supervisory), low battery (bit 43), debounced and latched input signal FXDB and FxLTCH for each input 5 (bits 44–54), even and odd parity (bits 55 and 56), program bit (bit 57), old stop bit (bit 58), logical 1 (bit 59), modulus eight count of logical 1's in bits 15–64 (bit 60–62), and logical 0 (bit 63).

The device ID code and device type code are available from EEPROM 17. The trigger count is a three-bit value generated by flip-flops 51 using signals TRGL and TRSTL from packet counter 15. Low battery signal LBAT is received from battery tester 16 (FIG. 10). The input and latch values are received from input processors 10 for inputs 5 on lines B44 to B54.

Even and odd parity bits are output from even and odd parity generators 52 and 53, respectively. Even parity generator 52 uses the output of modulation signal generator 54 to count the odd bits (only bits 15–63) and to generate a parity bit P1 so that the sum of the odd bits and the parity bit is even. P1 is input into a multiplexer 50 and added to each message packet at bit 55.

Odd parity generator 53 also uses the output of modulation signal generator 54 to count the value of the even bits (only 16–64) and generate a parity bit P2 so that the sum of the even bits and the parity bit is odd. P2 is input into a multiplexer 50 and added to each message packet as bit 56.

The old stop bit is generated at gate 55 as 366 μs off and allows the transmitter to be used with older system controllers that recognize only 58-bit message packets. Bit 59 is used as a dummy bit to clear the old stop bit, bit 58, and allow bits 60–63 to be properly processed.

Bits 60 to 62 can be used to provide error detection information that is processed by the system controller. For example, flip-flops 61 can be used to count the number of "ones" in bits 15 through 54. This count can then be processed by the system controller to determine if there are errors in the message packet.

Flip-flops 56 form a counter that counts the 64 bits of each message packet. Output signal CCC is sent to interval timer 14 to start the packet interval time delay.

Multiplexers 50 and associated gates 57, serially input data bits 15–63 into modulation signal generator 54. Modulation signal generator 54 converts the internal binary code, recognized as voltage on (1) or off (0), into the modulated binary code described above (1=122 μs RF on and 244 μs RF off, 0=122 μs RF on and 122 μs RF off). This modulation scheme is achieved by a divide-by-2 or -3 counter formed by gates 58 and flip-flops 59.

Battery tester 16 generates an output signal LBAT. When LBAT is logical 1 the battery is low and needs to be replaced or recharged. A good time to measure the battery is at the end of the transmission of a group of packets. In the block diagram of battery tester 16, shown in FIG. 10, the supply voltage is compared to a reference voltage. If the battery voltage drops too low, transmitter 1 may not function correctly and RF modulation circuit 3 may not generate a strong enough signal for the system controller to receive and decode the message packets. Therefore, each message packet includes information, at bit 43, on the status of the supply battery. When bit 43 is 0, the battery voltage is above the reference voltage, and when bit 43 is 1, the battery voltage is below the reference voltage. When the supply battery voltage is below the reference voltage, this information at bit 43 can be used by the system controller or monitoring station to warn the user that the battery must be checked.

The supply battery should be tested at a period of its lowest charge to ensure that a low battery signal is sent early enough to prevent failure of the system. The end of the transmission of the last packet was selected. Other timing points may be selected based on the desired sensitivity of the battery test function.

As discussed above, packet counter 15 generates signal PK7L at the end of transmission of the last packet. PK7L is used by transmit logic 12 to generate ENBLO. The ENBLO signal enables battery tester 16 to compare the battery voltage to the reference voltage and generate LBAT.

The LBAT signal is input into latch circuit 60 in transmitter logic 12. PK7L is also used to generate LBLL which goes low on the stop bit (bit 63) of the last packet. Latch circuit 60 then latches the LBAT signal for use in the next set of message packets.

The latched LBAT signal is not used in the last packet of the current packet transmission. If the battery is low, then the last packet may not be received or properly decoded by the system controller. The latched LBAT signal is used at bit 43 in each packet of the next group of packets transmitted (due to sensor activation or supervisory interval), increasing the probability that at least one message packet containing the low battery information will be received and properly decoded by the system controller.

Other embodiments are within the scope of the following claims.

What is claimed is:

1. A method for transmitting information via a message packet from a transmitter to a system controller in a security system, the method comprising the steps of:

transmitting a front porch pulse;

transmitting a set of synchronization bits;

transmitting a start bit;

transmitting information bits;

transmitting a first stop bit;

transmitting a set of error detection bits; and transmitting a second stop bit.

2. The method of claim 1 wherein the information bits include:

a set of data bits;

a set of trigger count bits for uniquely identifying each of a plurality of the message packets;

a low battery bit for indicating a low battery level condition associated with the transmitter;

a set of input bits for indicating a condition of a sensor associated with the transmitter;

a set of parity bits; and a programmable bit for flexible assignment to one or more of a variety of transmission tasks.

3. The method of claim 2 wherein the data bits include a sensor identification code and a device type code.

4. The method of claim 2 wherein the low battery bit is a logical zero when the battery is at or above a predetermined threshold, and is a logical one when the battery is below the predetermined threshold.

5. The method of claim 1 wherein the front porch pulse is a 976 microsecond radio frequency pulse.

6. The method of claim 2 wherein the transmitter includes a plurality of inputs and the input bits include a latch bit and a debounce bit for each input.

7. The method of claim 1 wherein the message packet includes about sixty-four bits of information to be decoded by the system controller.

8. The method of claim 7 wherein the message packet includes parity bits and the parity bits include even parity over odd bits 15 to 55 and odd parity over even bits 16 through 56.

9. The method of claim 7 wherein the error detection bits include a modulo eight count of the number of logical ones in bits 15 through 54.

10. A method for sending information from a transmitter to a system controller in a security system, comprising:

generating one or more message packets each time the transmitter receives a change in status condition from an associated sensor, wherein the message packet includes a front porch pulse, a set of synchronization bits, a start bit, a set of data bits, a set of trigger count bits for uniquely identifying each of the message packets, a low battery bit for indicating a low battery level condition associated with the transmitter, a set of input bits for indicating a condition of a sensor associated with the transmitter, a set of parity bits, a programmable bit for flexible assignment to one or more of a variety of transmission tasks, a first stop bit, a set of error detection bits, and a second stop bit; and sending each of the message packets from the transmitter to the system controller.

11. In a security system comprising a system controller and a plurality of remote transmitters with associated sensors, wherein each of the transmitters sends information to the system controller when an associated one of the sensors detects a change in condition, the improvement comprising a method for transmitting the information from the transmitter to the system controller via a message packet, the method comprising the steps of:

transmitting a front porch pulse, transmitting a set of synchronization bits, transmitting a start bit, transmitting a set of information bits, transmitting a first stop bit, transmitting a set of error detection bits, and transmitting a second stop bit.

12. The security system of claim 11 wherein the information bits include a set of data bits, a set of trigger count bits for uniquely identifying each of a plurality of the message packets, a low battery bit for indicating a low battery level condition associated with one of the transmitters, a set of input bits for indicating a condition of one of the sensors, and a set of parity bits.

13. A method for transmitting information via a message packet from a transmitter to a system controller in a security system, wherein the security system includes a sensor associated with the transmitter, the method comprising the steps of:

transmitting a front porch pulse;

transmitting a set of synchronization bits;

transmitting a start bit;

transmitting a set of data bits;

transmitting a set of trigger count bits for uniquely identifying each of a plurality of the message packets;

transmitting a low battery bit for indicating a low battery level condition associated with the transmitter;

transmitting a set of input bits for indicating a condition of the sensor associated with the transmitter;

transmitting a set of parity bits;

transmitting a first stop bit;

transmitting a set of error detection bits; and transmitting a second stop bit.

* * * * *